US011623805B2

(12) United States Patent
Huffer et al.

(10) Patent No.: US 11,623,805 B2
(45) **Date of Patent: *Apr. 11, 2023**

(54) CHILD RESISTANT PEELABLE PACKAGING

(71) Applicant: SONOCO DEVELOPMENT, INC., Hartsville, SC (US)

(72) Inventors: Scott William Huffer, Hartsville, SC (US); James J. Sanfilippo, Barrington, IL (US); John E. Sanfilippo, Barrington Hills, IL (US); Milorad Radenovic, Chicago, IL (US); Ricardo Costa, Schaumburg, SC (US); Eric Feld, Aurora, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/233,794

(22) Filed: Apr. 19, 2021

(65) Prior Publication Data

US 2021/0237956 A1 Aug. 5, 2021

Related U.S. Application Data

(63) Continuation of application No. 16/408,170, filed on May 9, 2019, now Pat. No. 11,021,305.

(Continued)

(51) Int. Cl.
*B65D 75/30* (2006.01)
*B65D 75/58* (2006.01)

(52) U.S. Cl.
CPC ..... *B65D 75/30* (2013.01); *B65D 75/5838* (2013.01); *B65D 75/5855* (2013.01); *B65D 2215/08* (2013.01)

(58) Field of Classification Search
CPC ..... B65D 75/30; B65D 75/5838; B65D 75/5855; B65D 2215/08

(Continued)

(56) References Cited

U.S. PATENT DOCUMENTS 3,389,852 A 6/1968 Emil
3,982,685 A 9/1976 Shimada (Continued)

FOREIGN PATENT DOCUMENTS

EP 0 298 054 A2 1/1989
EP 0 661 154 A1 7/1995

(Continued)

OTHER PUBLICATIONS

Office Action for Japanese Application No. 2013-173136 dated Sep. 29, 2015.

(Continued)

*Primary Examiner* — Steven A. Reynolds
(74) *Attorney, Agent, or Firm* — Nelson Mullins Riley & Scarborough LLP

(57) ABSTRACT

The invention includes a child resistant package having a first panel and at least two second panels joined to the first panel. The first and second panels are in different planes, in an embodiment. The package includes a peelable flap portion covering an access point into the package, wherein the peelable flap portion has at least one tab continuous therewith. The at least one tab is disposed on one of the second panels and the access point is disposed in the first panel. In an embodiment, at least one decoy tab is also disposed on one of the second panels.

19 Claims, 15 Drawing Sheets

Related U.S. Application Data

(60) Provisional application No. 62/674,302, filed on May 21, 2018, provisional application No. 62/670,371, filed on May 11, 2018.

(58) Field of Classification Search
USPC ..... 206/459.5, 484
See application file for complete search history.

(56) References Cited

U.S. PATENT DOCUMENTS

| | | | | |
|---|---|---|---|---|
| 4,260,061 | A * | 4/1981 | Jacobs | B65D 31/04 383/203 |
| 4,411,365 | A | 10/1983 | Horikawa et al. | |
| 4,420,080 | A | 12/1983 | Nakamura | |
| 4,468,811 | A | 8/1984 | Shaw et al. | |
| 4,552,269 | A | 11/1985 | Chang | |
| 4,572,377 | A | 2/1986 | Beckett | |
| 4,577,761 | A | 3/1986 | Nadaskay | |
| 4,610,357 | A | 9/1986 | Nakamura | |
| 4,653,250 | A | 3/1987 | Nakamura | |
| 4,679,693 | A | 7/1987 | Fonnan | |
| 4,739,879 | A | 4/1988 | Nakamura | |
| 4,784,885 | A | 11/1988 | Carespodi | |
| 4,790,436 | A | 12/1988 | Nakamura | |
| 4,795,271 | A | 1/1989 | Lane et al. | |
| 4,874,096 | A | 10/1989 | Tessera-Chiesa | |
| 4,923,309 | A | 5/1990 | VanErden | |
| 5,065,868 | A | 11/1991 | Cornelissen et al. | |
| 5,116,140 | A | 5/1992 | Hirashima | |
| 5,124,388 | A | 6/1992 | Pruett et al. | |
| 5,158,499 | A | 10/1992 | Guckenberger | |
| 5,167,455 | A | 12/1992 | Fonnan | |
| 5,333,735 | A | 8/1994 | Focke et al. | |
| 5,464,285 | A | 11/1995 | Anderson | |
| 5,535,885 | A | 7/1996 | Daniel et al. | |
| 5,613,779 | A | 3/1997 | Niwa | |
| 5,683,029 | A | 11/1997 | Lyons | |
| 5,836,697 | A | 11/1998 | Chiesa | |
| 5,855,435 | A | 1/1999 | Chiesa | |
| 5,862,101 | A | 1/1999 | Haas et al. | |
| 5,908,246 | A | 6/1999 | Arimura et al. | |
| 6,056,141 | A | 5/2000 | Navarini et al. | |
| 6,113,271 | A | 9/2000 | Scott et al. | |
| 6,126,317 | A | 10/2000 | Anderson et al. | |
| 6,296,884 | B1 | 10/2001 | Okerlund | |
| 6,309,106 | B1 | 10/2001 | Hooley | |
| 6,383,592 | B1 | 5/2002 | Lowry et al. | |
| 6,457,585 | B1 | 10/2002 | Huffer et al. | |
| 6,517,243 | B2 | 2/2003 | Huffer et al. | |
| 6,554,134 | B1 | 4/2003 | Guibert | |
| 6,589,622 | B1 | 7/2003 | Scott | |
| 6,918,532 | B2 | 7/2005 | Sierra-Gomez et al. | |
| 7,007,423 | B2 | 3/2006 | Andersson et al. | |
| 8,408,792 | B2 | 4/2013 | Cole et al. | |
| 8,545,099 | B2 | 10/2013 | Davis et al. | |
| 11,021,305 | B2 * | 6/2021 | Huffer | B65D 75/30 |
| 2003/0231811 | A1 | 12/2003 | Hodson et al. | |
| 2004/0150221 | A1 | 8/2004 | Brown | |
| 2004/0206637 | A1 | 10/2004 | Sierra-Gomez et al. | |
| 2005/0247764 | A1 | 11/2005 | Sierra-Gomez et al. | |
| 2005/0276525 | A1 | 12/2005 | Hebert et al. | |
| 2006/0018569 | A1 | 1/2006 | Bonenfant | |
| 2006/0171611 | A1 | 8/2006 | Rapparini | |
| 2007/0095709 | A1 | 5/2007 | Saito et al. | |
| 2007/0209959 | A1 | 9/2007 | Burgess | |
| 2008/0037911 | A1 | 2/2008 | Cole et al. | |
| 2009/0014350 | A1 | 1/2009 | Gaumont | |
| 2009/0226117 | A1 | 9/2009 | Davis et al. | |
| 2010/0018974 | A1 | 1/2010 | Lyzenga et al. | |

FOREIGN PATENT DOCUMENTS

| | | | |
|---|---|---|---|
| EP | 0 796 208 | B1 | 9/1997 |
| EP | 0 905 048 | A1 | 3/1999 |
| EP | 1 120 356 | A1 | 8/2001 |
| EP | 1 449 789 | A1 | 8/2004 |
| JP | H05-49622 | U | 6/1993 |
| JP | H05-51794 | U | 7/1993 |
| JP | H06-43645 | U | 6/1994 |
| JP | H10500378 | A | 1/1998 |
| JP | 2000-095282 | A | 4/2000 |
| JP | 2008-502555 | A | 1/2008 |
| JP | 2011 513153 | A | 4/2011 |
| KR | 2004-0025490 | | 3/2004 |
| WO | WO 95/30599 | A1 | 11/1995 |
| WO | WO 02/066341 | A1 | 8/2002 |
| WO | WO 03/059776 | A1 | 7/2003 |
| WO | WO 2005/123535 | A1 | 12/2005 |
| WO | WO 2008/051813 | A1 | 5/2008 |
| WO | WO 2011/146616 | A1 | 11/2011 |

OTHER PUBLICATIONS

International Search Report and Written Opinion for corresponding International Application No. PCT/US2019/031565, dated Sep. 19, 2019.

International Preliminary Report on Patentability for International Application No. PCT/US2019/031565; dated Nov. 11, 2020; 11 pages.

* cited by examiner

CHILD RESISTANT PEELABLE PACKAGING

CROSS-REFERENCE TO RELATED APPLICATIONS

This application claims priority to U.S. Non Provisional patent application Ser. No. 16/408,170, filed May 9, 2019, entitled "Child Resistant Peelable Packing", which claims priority to both U.S. Provisional Patent Application No. 62/670,371, filed May 11, 2018, entitled "Child Resistant Peelable Label" and U.S. Provisional Patent Application No. 62/674,302, filed May 21, 2018, also entitled "Child Resistant Peelable Label," wherein each of the foregoing is incorporated by reference in its entirety herein.

FIELD OF THE INVENTION

The present invention relates generally to the field of resealable flexible packaging and more particularly relates to peelable and resealable labels and integral packaging flaps which are child resistant.

SUMMARY OF THE INVENTION

In an embodiment, the invention comprises a child resistant laminate package comprising a first panel and at least two second panels joined to the first panel, wherein the second panels are disposed in a plane which is different from the plane of the first panel, and wherein the first and at least two second panels comprise: an inner layer; an outer layer; an adhesive layer disposed between the inner layer and the outer layer; wherein the outer film layer is scored to form at least one peelable flap portion comprising at least one tab which is continuous with the peelable flap portion, wherein the at least one tab is disposed at least partially on one of the at least two second panels; wherein the inner layer is scored to form at least one access point into the package, wherein the at least one access point is disposed at least partially within the location of the peelable flap portion; and wherein the access point is disposed at least partially in the first panel.

In another embodiment, the invention comprises a child resistant laminate package comprising a first panel and at least two second panels joined to the first panel, wherein the second panels are disposed in a plane which is different from the plane of the first panel, and wherein the first and at least two second panels comprise: an inner layer; an outer layer; an adhesive layer disposed between the inner layer and the outer layer; wherein the outer film layer is scored to form at least one peelable flap portion comprising at least one tab which is continuous with the peelable flap portion, wherein the at least one tab is disposed on one of the at least two second panels; wherein the inner layer is scored to form at least one access point into the package, wherein the at least one access point is disposed at least partially within the location of the peelable flap portion; wherein the access point is disposed in the first panel; and wherein the perimeter of the peelable flap portion comprises a connecting portion and two leg portions and wherein a first leg portion is disposed substantially on one second panel of the package and a second leg portion is disposed substantially on a different second panel of the package.

In yet another embodiment, the invention comprises a child resistant laminate package comprising a first panel and at least two second panels joined to the first panel, wherein the second panels are disposed in a plane which is different from the plane of the first panel, and wherein the first and at least two second panels comprise: an inner layer; an outer layer; an adhesive layer disposed between the inner layer and the outer layer; wherein the outer film layer is scored to form at least one peelable flap portion comprising at least one tab which is continuous with the peelable flap portion, wherein the at least one tab is disposed at least partially on one of the at least two second panels; wherein the inner layer is scored to form at least one access point into the package, wherein the at least one access point is disposed at least partially within the location of the peelable flap portion; wherein the access point is disposed at least partially in the first panel; and wherein at least one decoy tab is disposed on the at least one second panel such that the decoy tab is not scoredly continuous with the peelable flap.

The invention also comprises, in an embodiment, a method for making a child resistant package comprising: laminating an outer film layer to an inner film layer to form a laminate: forming an outer die cut in the outer film layer to define a peripheral edge of a peelable flap portion and at least one tab which is continuous with the peelable flap portion; forming an inner die cut in the inner film layer to define a location of an opening, wherein the inner die cut is formed inwardly of the outer die cut; printing at least one of the inner film and the outer film, wherein the print comprises at least one decoy tab which is visually similar to the at least one tab; and forming the laminate into a package having a first panel and at least two second panels joined to the first panel, wherein the second panels are disposed in a plane which is different from the plane of the first panel and the at least one tab and the at least one decoy tab is disposed on at least one of the second panels of the package.

In still another embodiment, the invention comprises a method for making a child resistant package comprising: laminating an outer film layer to an inner film layer to form a laminate; forming a first outer die cut in the outer film layer to define a peripheral edge of a peelable flap portion and at least one tab which is continuous with the peelable flap portion; forming at least one additional outer die cut in the outer film layer to define at least one decoy tab, wherein the decoy tab is not continuous with the peelable flap portion; forming an inner die cut in the inner film layer to define a location of an opening of the package, wherein the inner die cut is formed inwardly of the first outer die cut; and forming the laminate into a package having a front panel and at least two side panels such that the at least one tab and the at least one decoy tab are disposed on at least one of the side panels of the package.

In another embodiment, the invention comprises a method for making a child resistant package comprising: laminating an outer film layer to an inner film layer to form a laminate: forming an outer die cut in the outer film layer to define a peripheral edge of a peelable flap portion and at least one tab which is continuous with the peelable flap portion; forming an inner die cut in the inner film layer to define a location of an opening, wherein the inner die cut is formed inwardly of the outer die cut; forming the laminate into a package having a first panel and at least two second panels joined to the first panel, wherein the second panels are disposed in a plane which is different from the plane of the first panel wherein the at least one tab is disposed on one of the at least two second panels; wherein the opening is disposed in the first panel; and wherein the peripheral edge of the peelable flap portion comprises a connecting portion and two leg portions and wherein a first leg portion is disposed substantially on one second panel of the package and a second leg portion is disposed substantially on a different second panel of the package.

BRIEF DESCRIPTION OF THE DRAWINGS

The accompanying drawings, which are incorporated in and constitute a part of this specification, illustrate one or more embodiments of the invention and, together with the description, serve to explain the principles of the invention. A full and enabling disclosure of the present invention, including the best mode thereof directed to one of ordinary skill in the art, is set forth in the specification, which makes reference to the appended drawings, in which.

Figure 1A:
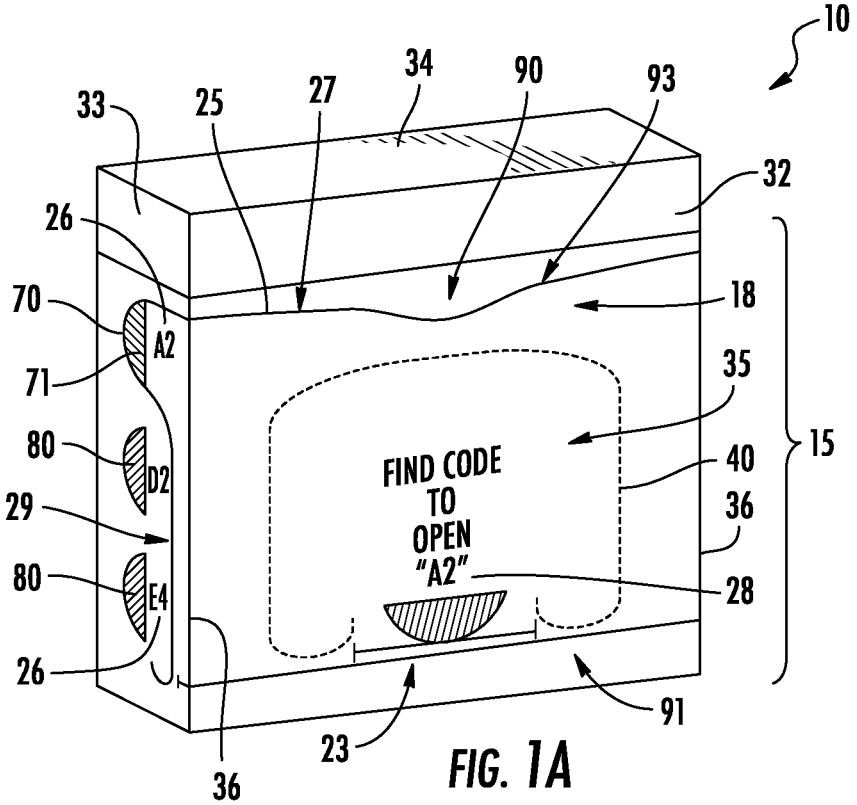
FIG. 1A illustrates a left side perspective view of an embodiment of a package with a child resistant label or flap.

Repeated use of reference characters in the present specification and drawings is intended to represent the same or analogous features or elements of the invention.

DETAILED DESCRIPTION OF THE EMBODIMENTS

Reference will now be made in detail to various embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. For example, the tab structures and configurations are interchangeable within and between embodiments. As another non-limiting example, the structures and configurations of the interrupted areas are interchangeable within and between embodiments. Thus, it is intended that the present invention covers such modifications and variations as come within the scope of the appended claims and their equivalents.

A variety of food and non-food products are packaged using flexible or semi-flexible packaging materials. Such packages may be formed from laminations of one or more of polymer films, metallized polymer films, paper, metal foil, and the like. In many instances, packages contain products that may be used or consumed a little at a time, and the products may be susceptible to being adversely affected (e.g., becoming soggy, drying out, etc.) by exposure to the surrounding environment. In these instances, there is a desire for resealable packaging. There is also a desire to prevent children from opening and accessing certain food and non-food products contained within resealable packages, such as packaging for laundry or dishwasher detergent tabs, pharmaceutical products, and/or food products which may contain ingredients that are unsafe or undesirable for consumption by children.

Through hard work and ingenuity, the inventors have invented a child resistant flexible packaging structure which has an integral resealable portion and have also invented a child resistant resealable label which can be applied to a separate packaging structure. The inventive label and/or integral resealable flap is resistant to being opened by children and can be used to reclose the package after its initial opening to keep the product that remains in the package fresh. Once reclosed, the package is, once again, child resistant. That is, the child resistance is present before the initial opening of the package and continues after the initial opening of the package.

In an embodiment, the invention comprises a label that is discrete and may be attached to the exterior of a product package, adjacent to or over the location where the package opening is presented. This inventive label may be formed separately from the packaging structure and then added to the packaging structure, at the production or filling site, for example. Alternatively, the label may be registered and applied to the packaging structure during an in-line manufacturing process. The inventive label may be affixed to the packaging structure using pressure-sensitive adhesive, permanent adhesive, or any other adhesive known in the art.

In another embodiment, the invention may comprise a child resistant pressure-sensitive adhesive flap which is formed integrally with the flexible packaging structure. In this embodiment, the packaging may comprise two or more layers and the flap portion may comprise the package opening or cover the package opening.

Figure 1B:
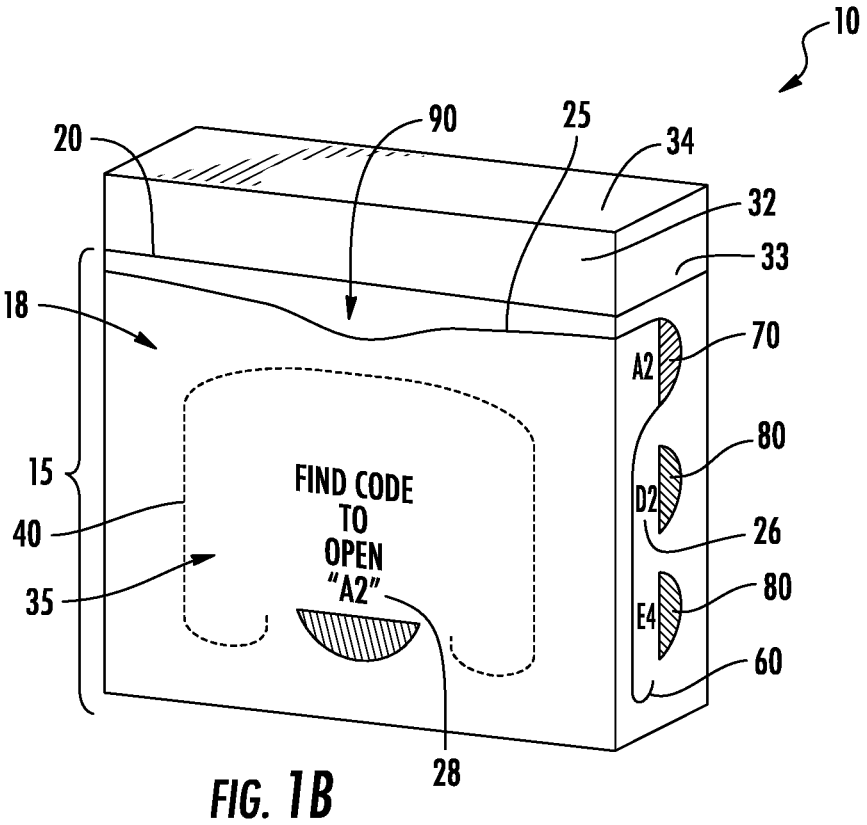
FIG. 1B illustrates a right side perspective view of an embodiment of a package with a child resistant label or flap.

Turning to the drawings, FIGS. 1A and 1B illustrate perspective views of a package 10 which comprises the inventive label 15. It should be understood that regardless of the terminology used herein (i.e. label or integral flap), the invention may take the form of a separately applied label or an integrally formed flap. Any of the features described as part of a label may be equally applied to an integrally formed flap and vice versa.

The package 10 is shown in FIG. 1 as a rectangular package, but it should be understood that the package 10 may comprise any shape or configuration known in the art. In some embodiments, the package 10 may comprise a standing pouch. In other embodiments, the package 10 may comprise a flexible bag, flow pack, guested package, handled package, flat-bottom bag, quad seal bag, quattro seal bag, tetrahedral bag, brick bag, corner-creased bag, sachet, pillow pouch/pack, or any other bag or package known in the art.

The package 10 illustrated in FIGS. 1A and 1B has a front panel 32, a back panel opposite the front panel, a top panel 34, a bottom panel opposite the top panel, and two side panels 33 which are opposite one another. In an embodiment, the access point 35 (shown in greater detail as item 535 in FIG. 5B) into the package 10 is disposed in the front panel 32. However, the access point 35 may disposed in any panel, face, or surface of the package 10. The access point 35 may be defined by a score mark, die cut, or cut line 40 in the packaging structure. The cut line 40 may be discontinuous (i.e. may comprise an open shape, such as a U-shape) or may be a closed shape (i.e. cut line 340, shown in FIG. 4). The cut line 40 may be perforated in some embodiments. The access point 35 in FIG. 1A is shown as covered by the label 15.

Alternatively, the access point may be an opening or aperture formed in a packaging structure, such as via thermoformed structures. Still further, the access point may be a seam or seal which is opened or broken by the consumer to access the package contents. The access point 35 may be any feature which allows a user to access the contents of a package.

FIGS. 1A and 1B illustrate the fact that the label 15 may, in an embodiment, cover some, most, or all of front panel 32 of the package 10 (or any other panel/face which contains the access point 35). In this manner, the label 15 is disposed so that it covers the access point into the package 10 until the label 15 is at least partially peeled back from the package 10. In an embodiment, the label 15 completely covers the access point 35 into the package 10, until the label 15 is at least partially peeled back, such that the contents of the package 10 cannot be accessed when the label 15 is in a closed position. In an embodiment, the label 15 is sized and configured so that it at least covers (i.e. is longer and wider than) the perimeter of the access point 35.

While the label 15 is shown as covering an access point 35 on the front panel 32, it should be understood that if the access point 35 for the package 10 is disposed in the top panel 34, for example, the label 15 will be disposed over such access point on the top panel 34. The label 15 (or peelable integral flap) may be presented on any surface or panel of the package known in the art.

In an embodiment, the label 15 additionally extends onto one or both of the side panels 33. In an embodiment, the label 15 extends onto both side panels 33. In a particular embodiment, the label 15 extends substantially onto each side panel 33. In yet another embodiment, the label 15 substantially or entirely covers each side panel 33. In still another embodiment, the label 15 wraps from the front panel 32, over each side panel 33, and at least partially onto the back panel as well.

In an embodiment, the label 15 and access point 35 are disposed at least partially in a first panel and at least two second panels are disposed adjacent the first panel. In an embodiment, these second panels are connected to the first panel via a fold, seam, or corner. In an embodiment, the second panels are disposed in a plane which is different from the plane in which the first panel is disposed. For example, the second panels may be disposed in a vertical plane while the first panel may be disposed in a horizontal plane. The first and second panels may be disposed at a non-zero angle with respect to each other. The angle may be a right angle, in an embodiment. In some embodiments, the angle between the first panel and each second panel is different. In other embodiments, the angle between the first panel and at least two of the second panels is the same.

In an embodiment, the label 15 is generally shaped and configured similarly to that of the package 10 to which it is applied or implemented as integral with. Thus, if the package 10 is generally rectangular, the overall label 15 or resealable flat portion may be generally rectangular.

The label 15 may comprise a cut line 25 which defines a peelable (and optionally resealable) flap portion 18. The flap portion 18 may comprise any shape or configuration known in the art. In an embodiment, the flap portion 18 of the label 15 may mirror the general shape of the label 15 and/or package 10. In an embodiment, the flap portion 18 covers the access point 35 and/or may mirror the shape of the access point 35. In other embodiments, the flap portion 18 may have a generally squared or U-shaped perimeter. The flap portion 18 may have two or more sides defined by score line 25. In an embodiment, the flap portion 18 has three sides defined by score line 25. The score line 25 defining the flap portion 18 may have a connecting portion 27 and two downwardly-extending leg portions 29. The flap portion 18 may be attached to the remainder of the label 15 and/or the package 10 along a hinge line 23 (i.e. an imaginary line extending between the free ends of the two legs of the cut line 25). The cut line 25 may be perforated in some embodiments. The terms cut line and score line may be used interchangeably herein.

In an embodiment, in addition to the label 15 extending onto one or both of the side panels 33, the flap portion 18 may also extend onto one or both of the side panels 33. In an embodiment, the flap portion 18 extends at least partially onto both side panels 33. In a particular embodiment, the flap portion 18 extends substantially onto each side panel 33. In a particular embodiment, the flap portion 18 extends to at least half of the dimension of at least one side panel 33. For example, if the side panel 33 measures 3 inches in width, the flap portion 18 may extend at least 1.5 inches into the side panel. In other embodiments, the flap portion 18 extends nearly to half of the dimension of at least one side panel 33.

Further, the cut line 25 may be disposed at least partially on one or both of the side panels 33. In an embodiment, the cut line 25 extends at least partially onto both side panels 33. In other embodiments, the label 15 extends onto one or both of the side panels 33, but the flap portion 18 and cut line 25 are disposed on the front panel of the structure.

In a particular embodiment, the connecting portion 27 of the cut line 25 may be primarily disposed on the first panel (where the access point 35 is disposed) and the two downwardly-extending leg portions 29 of the cut line 25 may be primarily disposed on at least one of the second panels (which are adjacent the first panel). In another embodiment, the connecting portion 27 of the cut line 25 may be at least partially disposed on the first panel (where the access point 35 is disposed) and the two downwardly-extending leg portions 29 of the cut line 25 may be at least partially disposed on at least one of the second panels (which are adjacent the first panel).

Figure 2A:
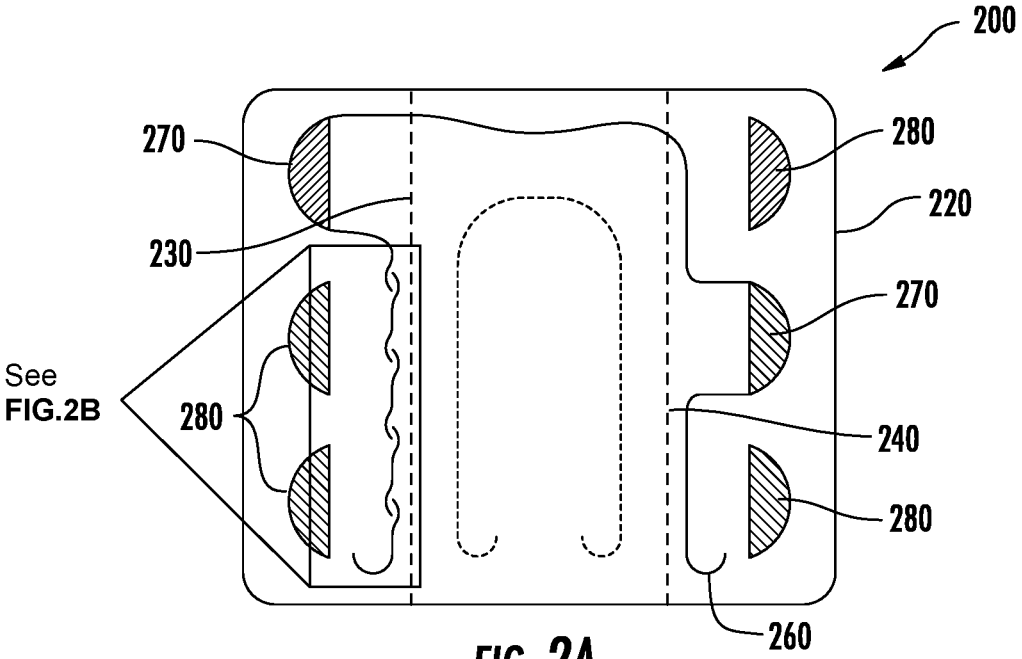
FIG. 2A is a top view of an embodiment of a child resistant label of the present invention.
Figure 2B:
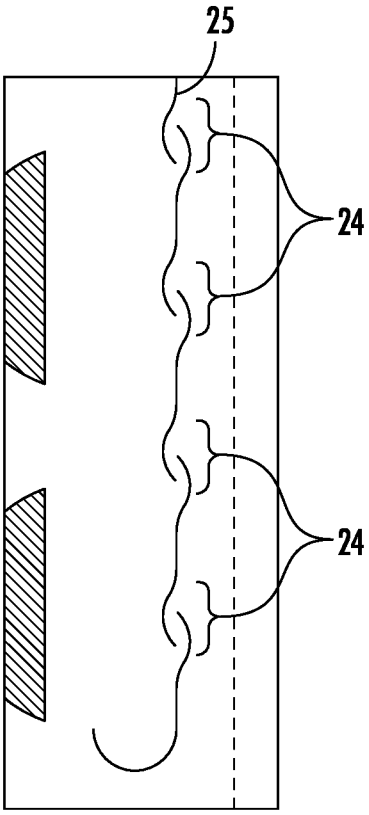
FIGS. 2B and 2C are exploded views of interrupted areas in an embodiment of a child resistant label of the present invention.
Figure 2C:
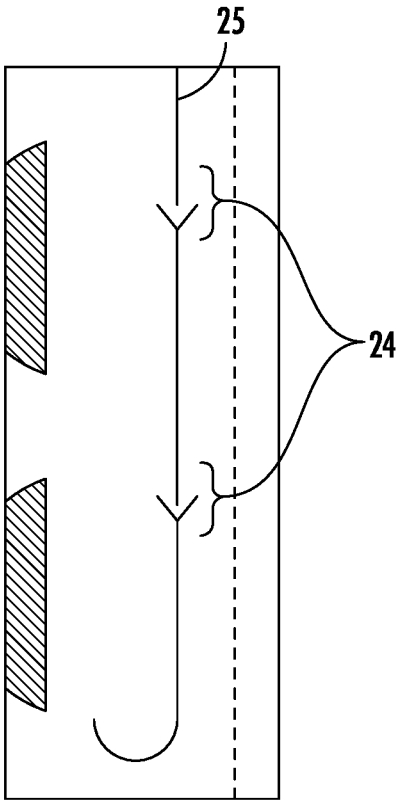

In an embodiment, cut line 25 defines at least one interrupted area 24 (shown, for example, in FIGS. 2A, 2B, and 2C). The interrupted area of the cut line 25, in an embodiment, is an area which has not been cut or scored. The interrupted area 24 may comprise a small or thin area of film disposed between two portions of cut line 25. When the resealable flap portion 18 is peeled back, at least a portion of the film in the interrupted area 24 is torn. In some embodiments, the interrupted area 24 can be formed by a transverse cut that is U-shaped or V-shaped (see FIG. 2C) to ensure that the tear will connect with the die cut 25. Similarly, the interrupted area 24 can be formed by adjacent curvatures or 'j-hooks', as shown in FIG. 2B. In this embodiment, the end point of a first j-hook may direct the tear toward the beginning point of its adjacent j-hook. Any interrupted area 24 configuration, or any other package integrity feature known in the art is contemplated by the invention. For example, FIG. 2C illustrates y-cut interrupted areas, wherein the arrow portion of the y-cut points downwardly. The arrow portion of the y-cut could be reversed, as will be understood.

In an embodiment, the interrupted areas 24 may not only provide package integrity features, but may also hold the diecut 25 in place as it is manufactured and dispensed. The interrupted areas 24 may additionally or alternatively prevent the resealable flap portion 18 from unintentionally peeling upwardly or outwardly during manufacture, while on the retail shelf, and/or while in the consumer's possession, prior to opening of the container.

In an embodiment, the interrupted area 24 may serve as a tamper evidence feature. In this embodiment, the presence of a tear or slit in the interrupted area 24 indicates that the package has already been opened or tampered with. Prior to the resealable flap portion 18 being peeled back, the uncut condition of the interrupted area 24 may be readily apparent from a visual inspection. When the resealable flap portion 18 is peeled back, the peeling force tears through the interrupted areas 24 to connect the two or more portions of the score line 25 on opposite sides of each interrupted area 24. If the resealable flap portion 18 is replaced to reseal the package, the torn condition of the interrupted area 24 may be readily apparent from a visual inspection. In an embodiment, printing on the package may include text or graphics adjacent to the interrupted areas 24 of the score line 25, calling the consumer's attention to the presence of the interrupted areas 24 and/or indicating that if they are torn through, the consumer should not purchase and/or consume the package.

In an embodiment, the resealable flap portion 18 of the label 15 extends at least partially over one or more panels of the package 10 which are different from the panel which comprises the access point 35. For example, if the access point 35 is disposed in the front panel 32, the resealable flap portion 18 may cover the access point 35 disposed in the front panel 32 and may additional extend at least partially over one or more side panels 33 or top and bottom panels. In an embodiment, the resealable flap portion 18 extends at least partially over one or more panels of the package 10 which are adjacent to the panel which comprises the access point 35. In an embodiment, the resealable flap portion 18 extends at least partially over two panels of the package 10 which are adjacent to the panel which comprises the access point 35. In an embodiment, the resealable flap portion 18 extends at least partially over two panels of the package 10 which are opposite each other and adjacent to the panel which comprises the access point 35.

In an embodiment, the resealable flap portion 18 has a first end 91 that is affixed to the package 10 and is not removable therefrom. In this embodiment, the resealable flap portion 18 also has a second, opposite end 93 that peels away from the package 10. In an embodiment, the second end 93 of the resealable flap portion 18 is linear. In another embodiment, the second end 93 of the resealable flap portion 18 is generally linear with the exception of a recessed portion 90 which extends away from the second end 93 and toward the first end 91 of the resealable flap portion 18. The recessed portion 90 may comprise any shape or configuration known in the art. In embodiment, the recessed portion 90 may be designed to prevent or discourage the consumer or user from opening the package 10 at the location of the recessed portion 90. For example, the recessed portion 90 may be positioned in the location which would normally house a pull-tab. A consumer may be drawn, based upon habit, to open a package 10 from that location. The recessed portion 90 may discourage such behavior and may further discourage children from attempting to open the package 10 using the second end of the resealable flap portion 18.

The recessed portion 90 may comprise a slight curvature toward the first end 91 of the package, toward the free ends of the leg portions 29 of the peelable flap portion 18, or toward a hinge line 23 disposed between the free ends of the leg portions 29. In an embodiment, the recessed portion is a U-shape, V-shape, or C-shape. The recessed portion 90 may be elongated and/or may be similarly sized to the access opening 35. In an embodiment, the cut line 25 is not readily visible to the consumer such that recessed portion 90 may not be visible or may not be obvious upon casual inspection of the package 10.

In an embodiment, the cut line 25 terminates on either side of the access point 35 (i.e. the ends of the "U" if the resealable flap portion 18 is generally U-shaped) near the first end 91 of the package 10. The termination point of the cut line 25 may comprise a "j-hook" 60 or a back hinge, but it should be understood that any mechanism which creates a stopping point that inhibits the complete removal of the resealable flap portion 18 from the product package could be utilized. In other embodiments, the cut line 25 may terminate at the end of the label 15, or may be a dosed shape, allowing the flap portion 18 to be completely removed from the product package. In an embodiment, the flap portion 18 is removable, but not resealable.

In a particular embodiment, the j-hooks 60 or back hinges are disposed in the same plane as the tab 70. In an embodiment, the j-hooks 60 are disposed in a different plane from that of the tab 70. In an embodiment, the j-hooks 60 and the tab 70 are disposed in the same plane, but in a plane which is a different plane from that of the access point 35 of the package. For example, the access point 35 of the package may be disposed on the front panel of the package while the tab 70 and/or the j-hooks 60 may be disposed on panels which are adjacent the front panel, but in a different plane from that of the front panel. In an embodiment, the panels containing the tab 70 and/or j-hooks 60 may be disposed at a non-zero angle from the panel containing the access point 35. In an embodiment, this may be a 90 degree angle or may be substantially close to a 90 degree angle. In an embodiment, the panels containing the tab 70 and/or j-hooks 60 may be disposed perpendicularly or substantially perpendicularly from the panel containing the access point 35.

In an embodiment, disposing the j-hooks 60 or back hinges in a packaging plane which is different from that of the access point provides advantages to the invention. In an embodiment, the j-hooks 60 are "stay-open" features of the packaging structure. With reference to FIGS. 1A and 5C, as the package is opened using the tab 70 and the peelable flap 18, the peelable flap 18 begins to stretch over the seam, corner, or fold 36 between the panel 32 containing the access point 35 and the panels 33 containing the j-hooks 60. The peelable flap 18 may even buckle slightly at or near the hinge line 23 as the flap 18 is peeled to its fully open configuration. The stretching and buckling of the flap 18 over the folds 36 between the adjacent panels 32, 33, in the location of the hinge line 23, forces the peelable flap 18 to remain in the open position (partially open position is shown in FIG. 5B; fully open position shown in 5C, buckling is shown across the hinge line 523, over folds 536). The package is unlikely to close without user-exerted effort when in this position. If the user desires to close the package, the user must then pull the peelable flap 18 outwardly and/or downwardly, toward the access point 35, sufficiently to overcome the buckling along the hinge line 23, in order to close the package.

In an embodiment, the cut line 25 which defines the resealable flap portion 18 comprises a continuous cut line which extends partially, but not fully, through the label 15. In another embodiment, the cut line 25 which defines the resealable flap portion 18 comprises a continuous cut line which extends fully through the label 15. In still another embodiment, the cut line 25 which defines the resealable flap portion 18 comprises a perforated line which extends fully through the label 15 at the point of each perforation.

In an embodiment, the resealable flap portion 18 comprises at least one tab 70 which is grasped and pulled away from the packaging structure to lift the flap portion 18 and provide access to the container contents through the access point 35. In an embodiment, resealable flap portion 18 comprises two tabs 70. In an embodiment, resealable flap portion 18 comprises a plurality of tabs 70.

In an embodiment, the tab(s) 70 may be disposed on a panel of the packaging structure which is different from the panel which comprises the access point 35 into the package. For example, if the access point 35 is disposed in the front panel 32, the tab(s) 70 may be disposed on one or more side panels 33. In this embodiment, the tabs 70 may be disposed in a location which would be considered the "grip" location of the package—i.e. the location wherein the user would hold or grip the package to conveniently open it. In this embodiment, the user may be required to change his/her grip and/or move his/her fingers in order to access the tabs 70 and pull them from the package 10. This provides yet another layer of child resistance, as a child may not have the ability to change his or her grip in a manner that allows access to the tabs 70 while holding the package 10.

Similarly, if the access point 35 is disposed in the top panel 34, the tab(s) 70 may be disposed on the front panel 32 and/or the back panel, or alternatively may be disposed on one or more side panels 33. In an embodiment, the tab(s) 70 are disposed on one or more panels which are adjacent the panel which comprises the access point 35. Placing the tabs 70 on a panel which is different from the panel which comprises the access point 35 into the package and/or comprises the primary label of the package 10 may be a deterrent to children attempting to access the package 10. Children may be drawn to the labeling panel and may overlook the fact that the opening tabs 70 are located on separate panels.

In an embodiment, two or more tabs 70 may be utilized and may be disposed on different panels of the packaging structure. For example, if the access point 35 is disposed in the front panel 32, the tabs 70 may be disposed on opposite side panels 33. Similarly, if the access point 35 is disposed in the top panel 34, the tabs 70 may be disposed on the front panel 32 and the back panel, or alternatively, may be disposed on opposite side panels 33. In these embodiments, the two or more tabs 70 must be grasped and pulled away from the packaging structure in order to reveal the access point 35. It may be required that the tabs 70 are grasped and pulled simultaneously or grasped and pulled in turn, in embodiments. Having two or more tabs 70 that must be used to open the package is an additional deterrent to children. Even if a child were to identify one opening tab 70, it is less likely that the child would be able to locate both opening tabs 70 and simultaneously or progressively pull both.

In an embodiment, in order to reveal the access point 35, the flap 18 must be pulled in multiple directions. For example, the resealable flap portion 18 may require that the tabs 70 are pulled in an upward direction and then the resealable flap portion 18 is pulled in an outward or downward direction, with reference to the packaging structure. Any directions known in the art are contemplated by the invention. Again, this serves as an additional deterrent to children. Not only must the opening tabs 70 be identified and one or both pulled or lifted in a first direction, but then the resealable flap portion 18 must additionally be lifted or pulled in a second direction, thereby limiting the likelihood that a child will access the package contents.

The label 15 may be affixed to the package 10 through use of one or more adhesives. The adhesives may comprise any adhesive known in the art. In some embodiments, the adhesive may comprise a pressure sensitive adhesive ("PSA"). Any suitable PSA known in the art may be utilized in the present invention. The PSA may form viscoelastic bonds that are aggressively and permanently tacky, adhere without the need of more than a finger or hand pressure, and require no activation by water, solvent or heat. The PSA may be based on non-crosslinked rubber adhesives in a latex emulsion or solvent-borne form, or can comprise acrylic and methacrylate adhesives, styrene copolymers (SIS/SBS), and silicones. The adhesive may comprise an acrylic, a natural rubber, a synthetic rubber, a silicone, a butyl, or an ethylenevinylacetate ("EVA"). If the package of the invention is to be used for food packaging, the PSA may be a food-grade composition. In other embodiments, a cohesive may be utilized to affix some or all portions of the label 15 to the package 10.

In a particular embodiment, a PSA is selected such that it can be flood coated or disposed to substantially cover the label 15 such that it secures the label 15 to the package 10, but also allows the resealable flap portion 18 to release from the package 10. Alternatively, more than one adhesive may be utilized, wherein the adhesives allow the bonding of the label 15 to the package 10 at different levels of affinity. For example, an adhesive having a greater bonding affinity may be selected and utilized to adhere the label 15 to the package 10 in certain areas outside of the resealable flap portion 18. An adhesive having a lesser bonding affinity may be selected and utilized to adhere the label 15 to the package 10 in the area of the resealable flap portion 18. In an embodiment, the adhesive(s) utilized allow the resealable flap 18 to be separated from and resealed to the package 10 multiple times by the end user.

In an embodiment, the tabs 70 may be partially or entirely adhesive-free. In such an embodiment, for example, the outermost edge 71 of a tab 70 may be adhesive-free, allowing a user to slide a finger beneath the outermost edge 71 of a tab 70 to lift it. The portion of the tab 70 which is adhesive free may be located in any position of the tab, nearest the top, bottom, or rear of the packaging structure, in an embodiment. In an embodiment, the adhesive-free tabs 70 or portions thereof may be formed by deadening or deactivating any adhesive that has been applied in the location of the tab 70, using any method known in the art. In another embodiment, the adhesive-free tabs 70 may be formed by pattern-applying the adhesive to the label 15 to avoid the location of the tabs 70.

In an embodiment, the portion of the label 15 which covers the access point 35 may also or may alternatively be adhesive-free. This adhesive-free portion may be formed similarly to that described above. Providing a label which is adhesive-free in the location of the access point 35 may prevent the packaging contents from sticking to the label, in an embodiment.

In an embodiment, the label 15 additionally comprises decoy tabs 80. In this embodiment, one or more decoy tabs 80 may be positioned adjacent or near the tabs 70. The decoy tabs 80 may visually appear to be continuous with the flap portion 18, in an embodiment, but may be scoredly discontinuous therewith. In other words, the decoy tabs 80 may look like they are connected to the flap portion 18 as a result of printed matter and/or graphics, but the decoy tabs 80 either may not be scored at all or may be scored in a way that they are not continuous with the flap portion 18. That is, only one side of the decoy tabs 80 may be scored or the score lines of the decoy tabs 80 may not connect to the score lines 25 of the peelable flap 18.

The decoy tabs 80 may be designed such that they visually appear to be actual tabs that will aid in removing the resealable flap portion 18 from the package 10. In an embodiment, however, the decoy tabs 80 may be visible as printed material only and may not be defined by a cut line, such that they are not separatable or removable from the label. Alternatively, the decoy tabs 80 may be defined by a cut line or partial cut line, but the cut line may not connect to the resealable flap portion 18 and, therefore, cannot aid in removing the resealable flap portion 18. Similarly, the decoy tabs 80 may be defined by a cut line which is a closed shape that does not connect to the resealable flap portion 18, such that when the decoy tab 80 is pulled, it is removed from the package 10 but does not peel back the resealable flap portion 18. In yet another embodiment, the decoy tabs 80 may be defined by a cut line or partial cut line, but may not be adhesive-free, such that the decoy tabs 80 will not release easily from the package 10.

In an embodiment, one or more decoy tabs 80 are disposed on the same panel as the tab(s) 70. In a particular embodiment, two decoy tabs 80 are disposed on each panel which houses a tab 70. The decoy tabs 80 provide additional means of confusion and distraction, preventing a child from easily knowing which tab is an opening tab 70 and/or how to open the package 10. In an embodiment, the decoy tabs 80 are vertically aligned with each other and/or any tabs 70 disposed on the side panel.

In an embodiment, the decoy tabs 80 are visually similar to or identical to the tabs 70. That is, the decoy tabs 80 may have the same (or substantially the same) shape, size, and/or color configuration as the tabs 70. The decoy tabs 80 may be positioned in the same (or substantially the same) configuration as the tabs 70. The decoy tabs 80 may be positioned parallel to the tabs 70. In an embodiment, the decoy tabs 80 comprise a printed design that mimics the tabs 70, but there is no cut line which actually defines the decoy tabs 80.

In an embodiment, the tabs 70 and the decoy tabs 80 each display certain indicia 26. In some embodiments, the indicia 26 may comprise graphics, colors and/or patterns—instructing the user to find a certain graphic element, tab color, or tab pattern. In other embodiments, the indicia 26 may comprise a code, words, instructions, letters, numbers, or combinations of letters and numbers. In an embodiment, the indicia are scrambled. In an embodiment, the indicia 26 associated with the decoy tabs 80 are each different from each other. In an embodiment, if more than one tab 70 is presented, the indicia 26 associated with each tab 70 is the same. The indicia 26 may be positioned on or adjacent the tabs 70 and decoy tabs 80.

In an embodiment, the label 15 additionally comprises directions 28. The directions may inform the consumer as to which tab(s) are the removable tab(s) 70 which should be used to open the package 10. In this regard, the consumer also understands which tab(s) are the decoy tabs 80 (i.e. those that are not the tab(s) 70). The directions 28 may tell the consumer to find a particular code, word, letter combination, letter/number combination, or the like. The directions 28 may provide an example tab which should match tab 70. The directions 28 may present a puzzle or question and the tab(s) 70 may provide the correct answer, in an embodiment. Any directions 28 which inform a consumer as to which tab is the tab 70, the opening tab, is contemplated herein. The directions 28 and corresponding matching/unmatching indicia 26 provide yet another child resistance feature of the invention. The directions 28 may comprise words and/or sentences that a child cannot read, a puzzle that a child cannot solve, and/or the indicia 26 may comprise confusing letter/number combinations that a child cannot make sense of, further limiting the likelihood that a child will be able to access the package contents.

In an embodiment, the directions 28 are presented on the portion of the label 15 which covers the access point 35. In another embodiment, the directions 28 are presented on the resealable flap portion 18. In an embodiment, the directions 28 are intermixed with the packaging logos and graphics to further camouflage them from a child.

In an embodiment, the packaging structure and/or the label 15 of the invention may comprise any flexible packaging known in the art, including but not limited to, polymer films, metalized polymer films, papers, metal foils, polyester films, polyolefin films, polyethylene terephthalate (PET), oriented polypropylene (OPP), metalized polyester (MPET), any combination thereof, or any other suitable film known in the art. In various embodiments, the packaging structure and/or the label 15 may comprise multiple layers. In various embodiments, the packaging structure and/or the label 15 may comprise a multi-layer film. In an embodiment, the packaging structure and/or the label comprises a pre-printed film.

In certain embodiments, the label 15 of the invention may comprise a barrier layer, providing a barrier against the passage of oxygen and/or moisture. In other embodiments, the label 15 may additionally comprise one or more metallization layers or foil layers.

In an embodiment, the package 10 may additionally comprise tamper-evident indicators. The tamper evident indicators may comprise any form known in the art used to indicate whether a package has been previously opened or whether the integrity of the package has been compromised. In an embodiment, the tamper evident indicator may provide an uninterrupted film area that breaks upon opening of the package 10 and remains on the package 10 after it is opened. In another embodiment, the tamper evident indicator may comprise a paper sticker which is permanently adhered over a portion of the label 15, breaks upon opening of the package 10, and remains on the package 10 after it is opened for evidence of tampering. In an embodiment, the tamper evident indicators may include an area of weakness created, for example, by a scored, perforated, or thinned line or by forming the tamper evident indicator out of a highly oriented material that has a tendency to split along a break line. In an embodiment, the invention utilizes tamper-evident indicators as more fully described in U.S. patent application Ser. No. 15/017,743 to Gagne, which is incorporated by reference herein in its entirety.

In a particular embodiment, the tamper evidence of the package may be indicated due to a misalignment of graphics. For example, the packaging graphics may be designed such that once the package is opened, it is very difficult, if not impossible, to completely realign the graphics upon reclose of the package. For instance, the graphics may stretch or become distorted in one or more areas, or along the cut line, upon opening of the package. In such cases, if the graphics are misaligned, a user is aware that the package has been opened.

In an embodiment, the package 10 may define multiple cavities for storage of products. In this embodiment, for example, there may be separate cavities on the left and right side of the package 10, optionally separated by an internal divider.

Figure 7:
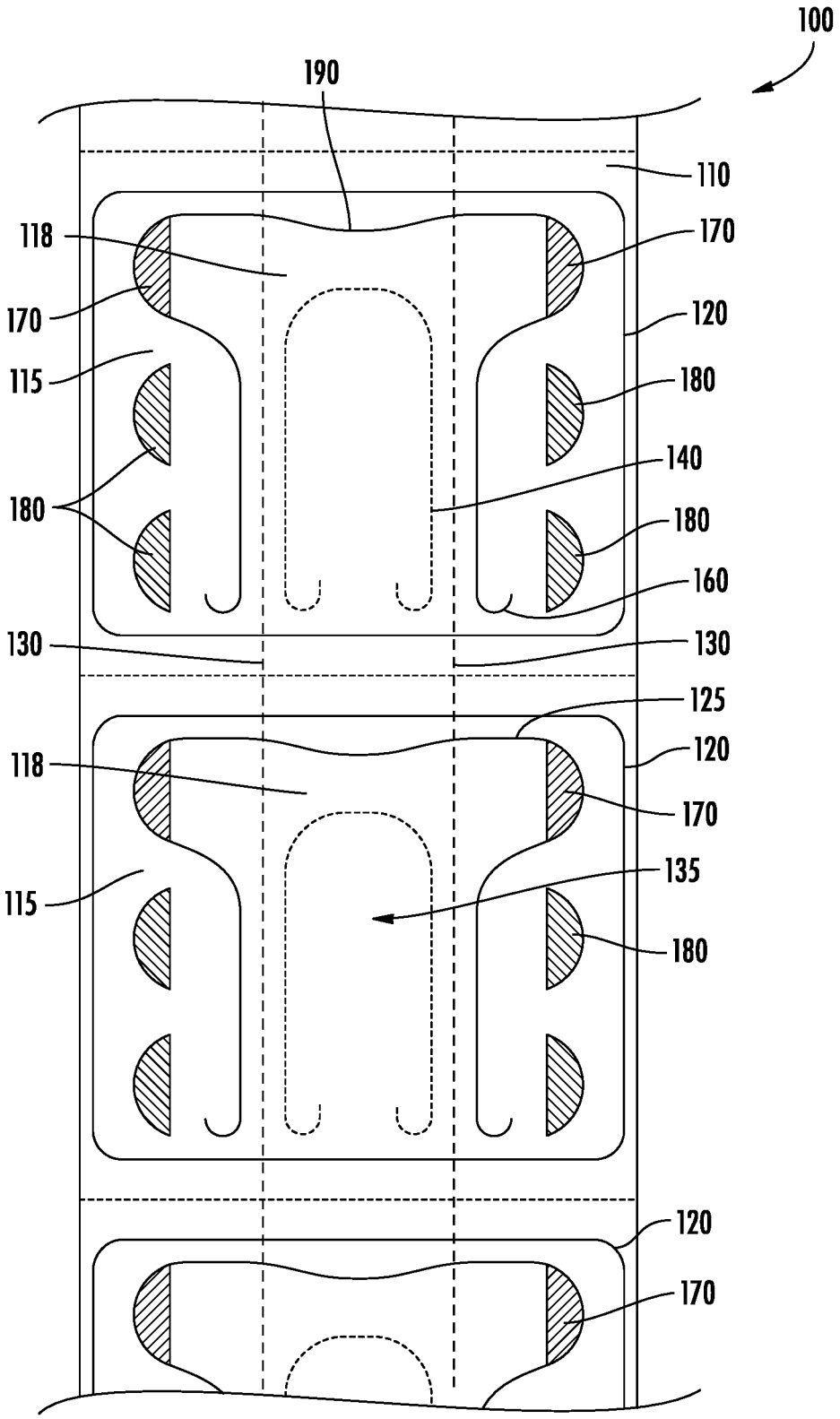
FIG. 7 illustrates a rollstock layer with discrete labels according to an embodiment of the present invention.

In an embodiment, the invention comprises a discrete label which may be separately applied to a packaging structure. FIG. 7 illustrates an embodiment of the discrete label. In this embodiment, cut line 120 defines the perimeter of the discrete label. Recessed portion 190 is shown in the connecting portion of cut line 125, which defines the peelable flap 118. In this embodiment, the label 115 is shown as adhered to a rollstock packaging structure 110, forming a laminate 100. In an embodiment, the label 115 and rollstock 110 are laminated using adhesive (permanent, PSA, or a combination thereof), before or after disposing the cut lines in the various film structures.

In this embodiment, cut line 120 may be disposed through both the label 115 and the rollstock 110. However, in an embodiment, the rollstock layer 110 may be replaced with a disposable liner and the cut line 120 may be disposed through only the label 115. In another embodiment, the label 115 may be a single ply and cut line 120 may, in an embodiment, comprise perforations to be separated before adherence to a package.

In this embodiment, the resealable flap portion 118 is defined by cut line 125 and ends in j-hooks 160, as shown in FIG. 2A. The resealable flap portion 118 extends from the center of the label 115 outwardly, over the fold lines 130. The fold lines 130 represent the fold lines of the final package 10. Cut line 140 is disposed in the rollstock 110 and does not, in an embodiment, continue through or into the label 115. Tabs 170 are shown in cross-hatching and decoy tabs 180 are shown in single hatching.

After the scoring, cutting, perforating, and adhering steps have occurred, the discrete label 115 may be removed from the skeleton and/or liner and adhered (using separate adhesive or using the adhesive applied during manufacture) to a package. This may occur in a separate location, using separate equipment, if desired.

Figure 8:
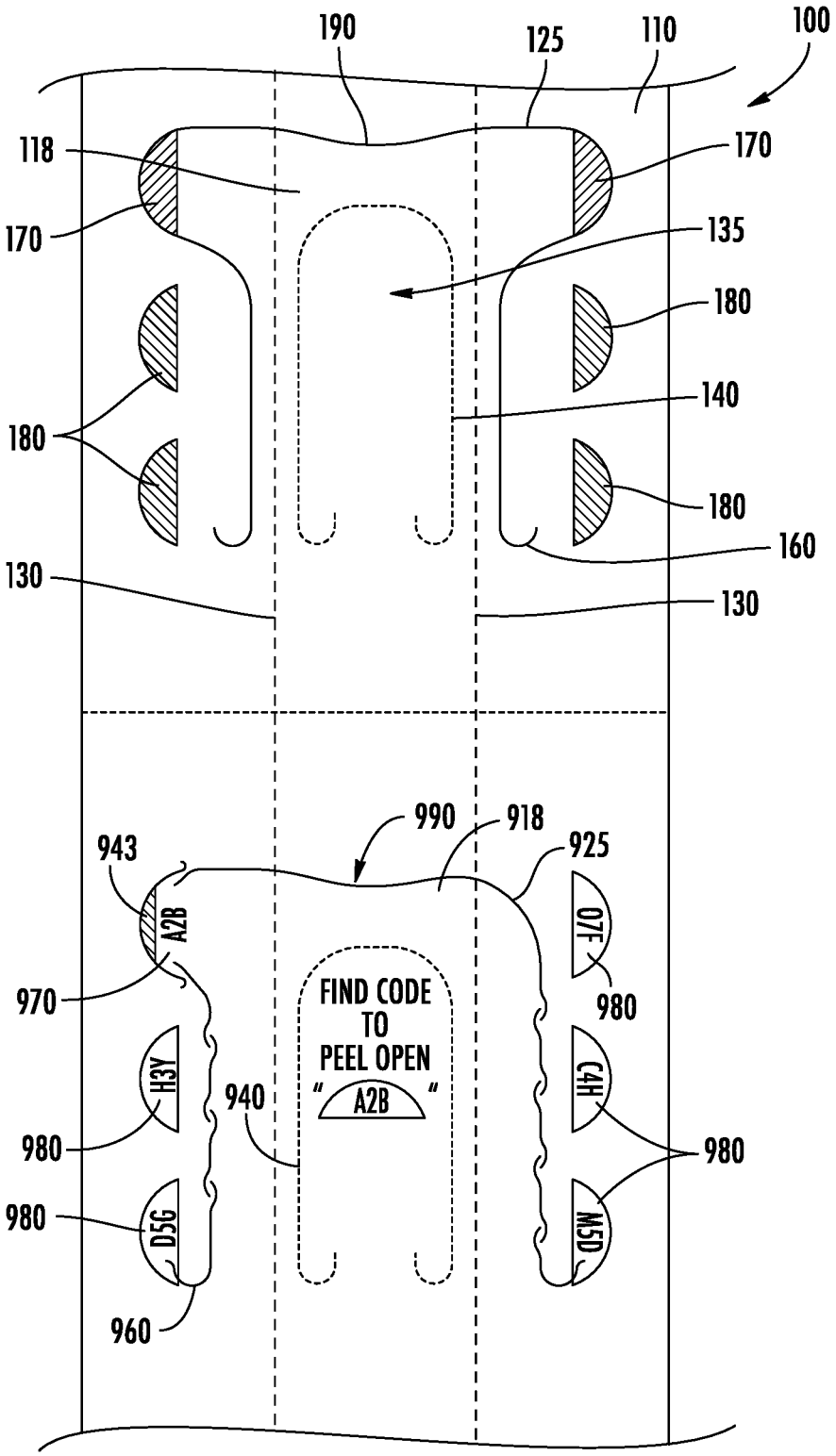
FIG. 8 illustrates a packaging structure with an integrated peelable flap according to an embodiment of the present invention.

FIG. 8 illustrates an alternate embodiment of the invention wherein the label is formed as an integral part of the packaging. In this embodiment, the packaging structure may comprise a multi-layer film laminate. The laminate may comprise an inner structure (or lower structure) and an outer structure (or upper structure). The outer structure may be adhesively joined to the inner structure before or after die cuts and/or scoring. A score line 125 in the outer structure may define an outer opening, described herein as the resealable flap 118.

In this embodiment, the inner structure may additionally comprise a score line 140. The inner structure score line 140 may be generally parallel to the score line 125 defining the resealable flap. In other embodiment, the inner score line 140 may be similarly shaped but not parallel to the outer score line 125. In still other embodiments, the score lines 140 and 125 may be differently shaped. The inner structure score line 140 may be spaced inwardly of the outer structure score line 125 so as to define an inner opening portion 135, which is of smaller area than the outer opening portion 118. The inner structure score line 140 can be a closed shape such as a rectangle, oval, or ellipse, or can be generally U-shaped like the outer structure score line.

In an embodiment, a marginal region of the outer opening portion extends beyond the edge of the inner opening portion. PSA is, in an embodiment, disposed in this marginal region, between the inner and outer structures (see FIG. 5B, PSA 595). The PSA may be disposed on the underside of the outer structure or the upper side of the inner structure. In this embodiment, the PSA may be applied to the outer structure and may remain on the outer structure upon opening, but it is also within the scope of the invention to apply the PSA to the inner structure and to remain on the inner structure upon opening.

When the outer opening portion 118 is detached from the outer structure along the outer structure score line 125 and is peeled back, the inner opening portion 135 may remain affixed to the outer opening portion and come with it, thereby creating an opening in the top surface of the package as defined by the inner structure score line. In an alternate embodiment, the inner opening portion 135 is created during the cutting portion of the manufacturing process and the inner layer contains an aperture 135. In either case, the outer and inner opening portions form a flap 118 that remains attached along a hinge line 23 defined between the free ends 160 of the two legs of the U-shaped score lines 125.

FIGS. 2A-2C illustrate alternate embodiments of the inventive laminate 200. In the embodiment set forth in FIG. 2A, the tabs 270 are shown in dissimilar locations on the side panels of the label 220. For example, the tab 270 on the left side of the laminate is shown in the uppermost position while the tab 270 on the right side of the laminate is shown in the middle position of the laminate. In other examples, the tabs 270 may not be vertically aligned with one another on opposite sides of the package. Any position of tabs 270 is contemplated herein. This varied tab 270 location may add complexity and confusion to the removal process, aiding in the child resistant nature of the package 10. Decoy tabs 280, the free end 260 of the outer die cut, inner die cut 240, and fold lines 230 are also shown in FIGS. 2A-2C.

Figure 3:
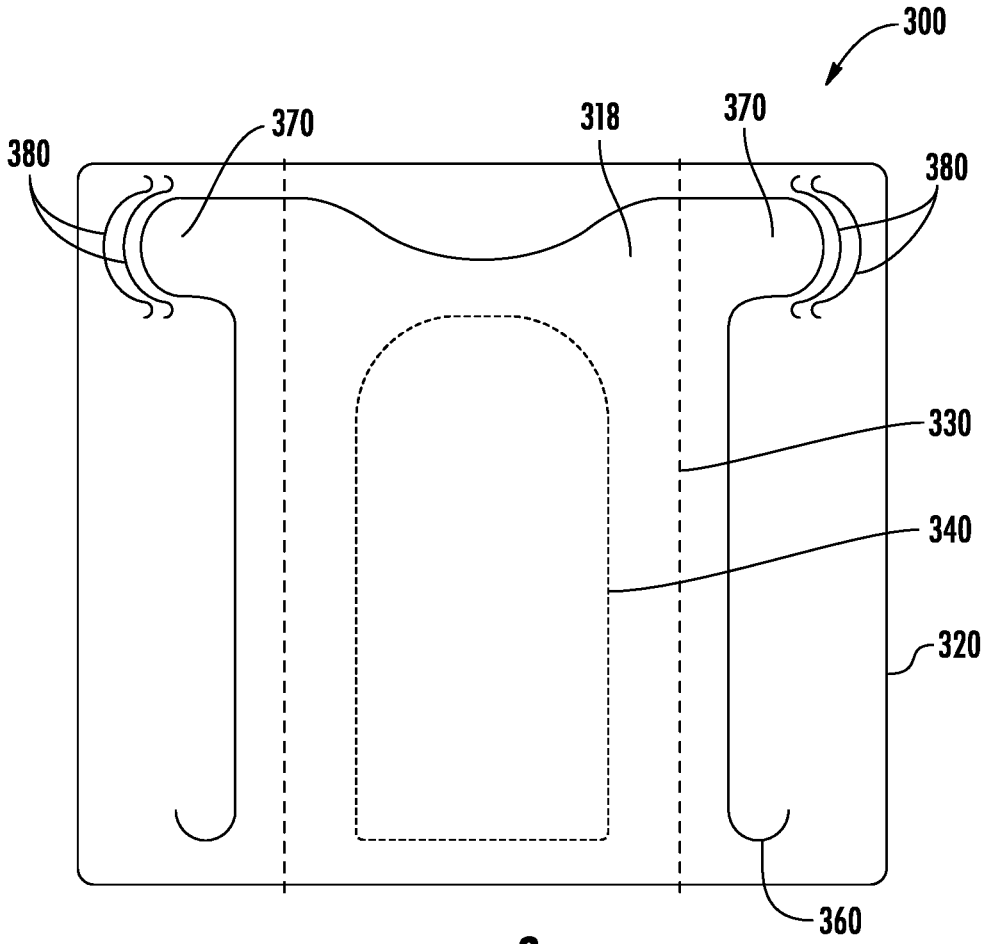
FIG. 3 is an alternate embodiment of a child resistant label according to an embodiment of the present invention.

FIG. 3 shows another alternate embodiment of the laminate 300. In this embodiment, the decoy tabs 380 are illustrated in line with, but outside the position of the opening tabs 370. In this embodiment, the decoy tabs 380 may comprise cut lines, but may have j-hook ends such that they do not connect with the resealable flap portion 318 and cannot aid in removal of the resealable flap portion 318. Alternatively, the decoy tabs 380 may be merely visual displays or printed matter. The free end 360 of the outer die cut, inner die cut 340, and fold lines 330 are also shown in FIG. 3.

Figure 4A:
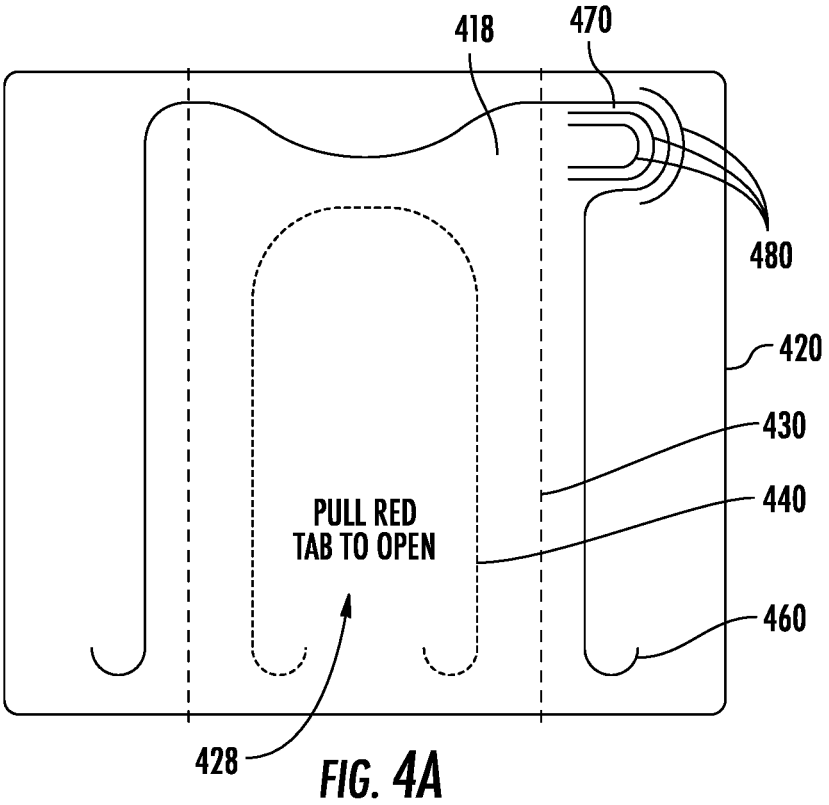
FIGS. 4A and 4B are alternate embodiments of a child resistant label according to embodiments of the present invention.

FIG. 4A illustrates still another embodiment of the laminate 400. In this embodiment, decoy tabs 480 are shown in line with, and both inside and outside the position of the opening tabs 470. In this embodiment, the decoy tabs 480 may comprise printed graphics and may not comprise cut lines or may comprise cut lines that do not connect with the resealable flap portion 418. The free end 460 of the outer die cut, inner die cut 440, and fold lines 430 are also shown in FIG. 4A-4B.

Figure 4B:
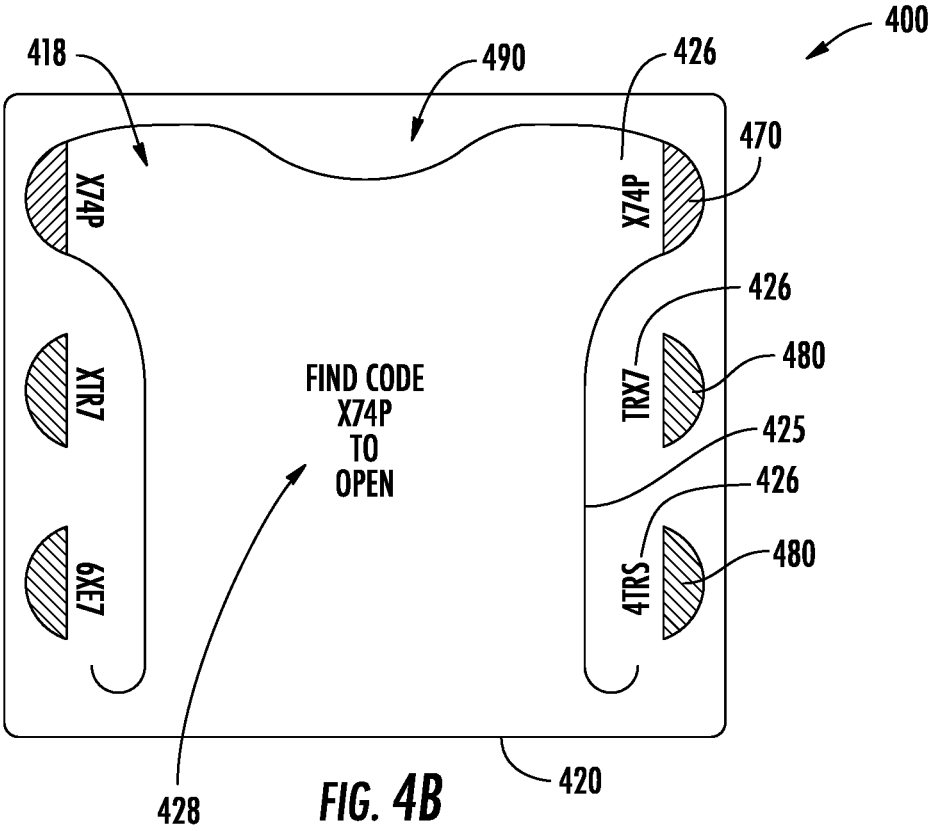

FIG. 4B illustrates yet another embodiment of the laminate 400. In this embodiment, the tabs 470 and decoy tabs 480 each have associated codes 426. The packaging may, in this embodiment, have displayed directions 428 which indicate which code matches the removable tabs 470. The tabs 470 and decoy tabs 480 may also comprise colors, shapes, lines, and/or patterns and the directions 428 may indicate, based upon those colors, shapes, lines, and/or patterns, which are the tabs 470 and the decoy tabs 480.

In embodiments wherein the decoy tabs 80 are printed graphics, such printing may be disposed on the outside of the label 15, the inner surface of the label 15, or the outer surface of the packaging structure. The printed decoy tabs 80 may complement or be integral with any labeling or printing ordinarily presented on the package.

Figure 5A:
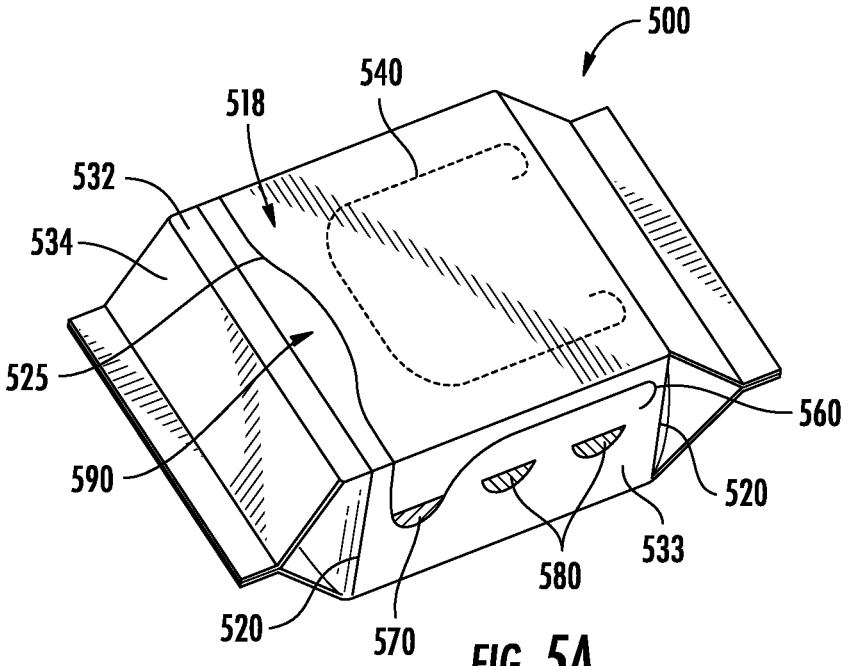
FIGS. 5A-5C illustrate an alternate embodiment of a child resistant label according to an embodiment of the present invention, in a closed (5A), partially open (5B), and fully open (5C) configuration.
Figure 5B:
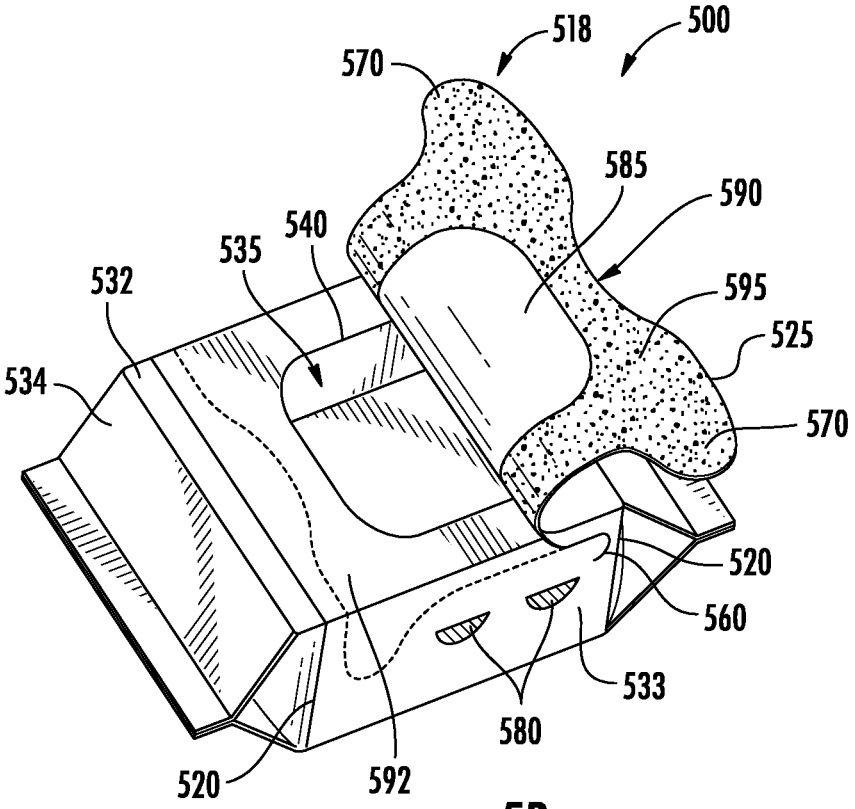
Figure 5C:
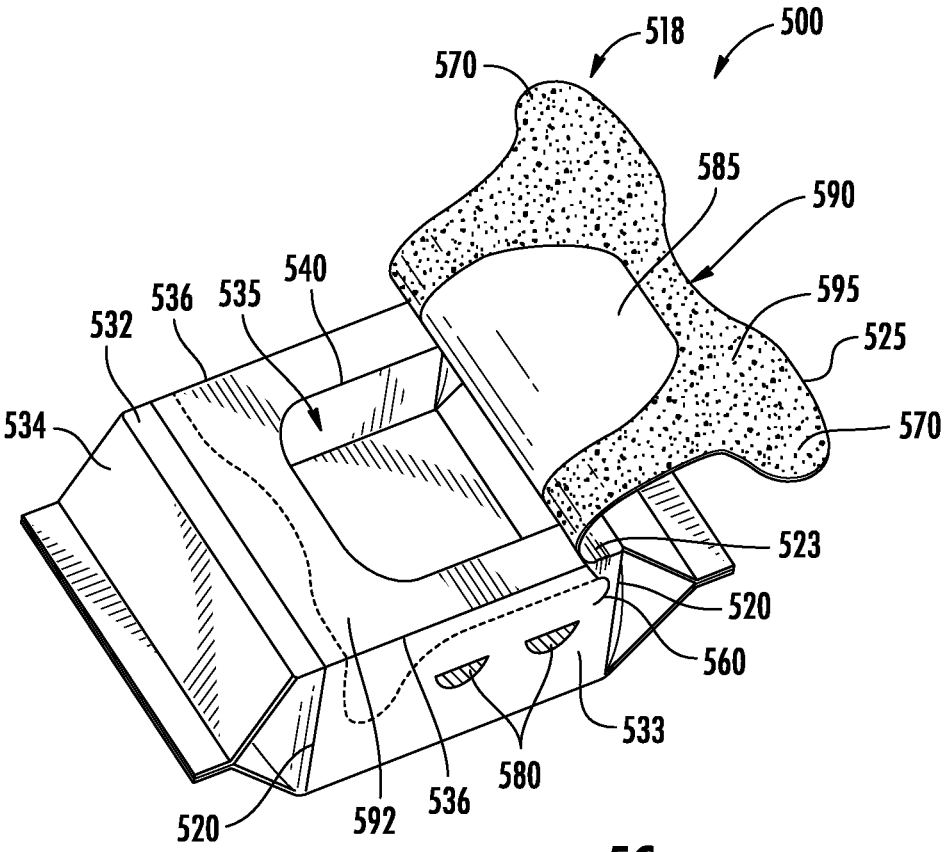

FIGS. 5A and 5B illustrate an embodiment of the invention wherein the package 500 is shown in a closed (FIG. 5A) and open (FIG. 5B) configuration. In this embodiment, PSA 595 is visible on the underside of the resealable flap portion 518 (see FIG. 5B). Additionally, the access point 535, defined by cut line 540, is easily viewable. The cover portion 585, that is, the portion which covers the access point 535, is shown as well. In some embodiments, the cover portion 585 may be a PSA-free portion of the outer film. In other embodiments, the cover portion 585 may be a part of the inner film which separates from the remainder of the inner film and remains attached to the flap portion 518 when the flap portion 518 is pulled away from the package 500.

The recessed portion 590 of flap portion 518 is shown, as is the free end 560 of the leg portion of cut line 525, which defines the flap portion 518. As is visible, the tabs 570 are visually aligned with the decoy tabs 580.

The package 510 is reclosable by re-attaching the resealable flap portion 518 to the surface 592 of the front panel 532 to restore the package to a closed condition as shown in FIG. 5A. The PSA 595 will re-adhere the resealable flap portion 518 to the front panel 532. Additionally, the tabs 570 can be at least partially re-attached to the side panels 533 of the package 510, using the PSA 595. In this manner, the package is resealed and is, again, child resistant. This process may be repeated as desired.

In this embodiment, a label may be applied to a packaging structure as a discrete separate label (shown by cut lines 520). Alternatively, however, the flap portion 518 shown in FIGS. 5A and 5B could be formed integrally with the packaging structure, in which case cut lines 520 would not be displayed but the structure would otherwise look the same.

Figure 6:
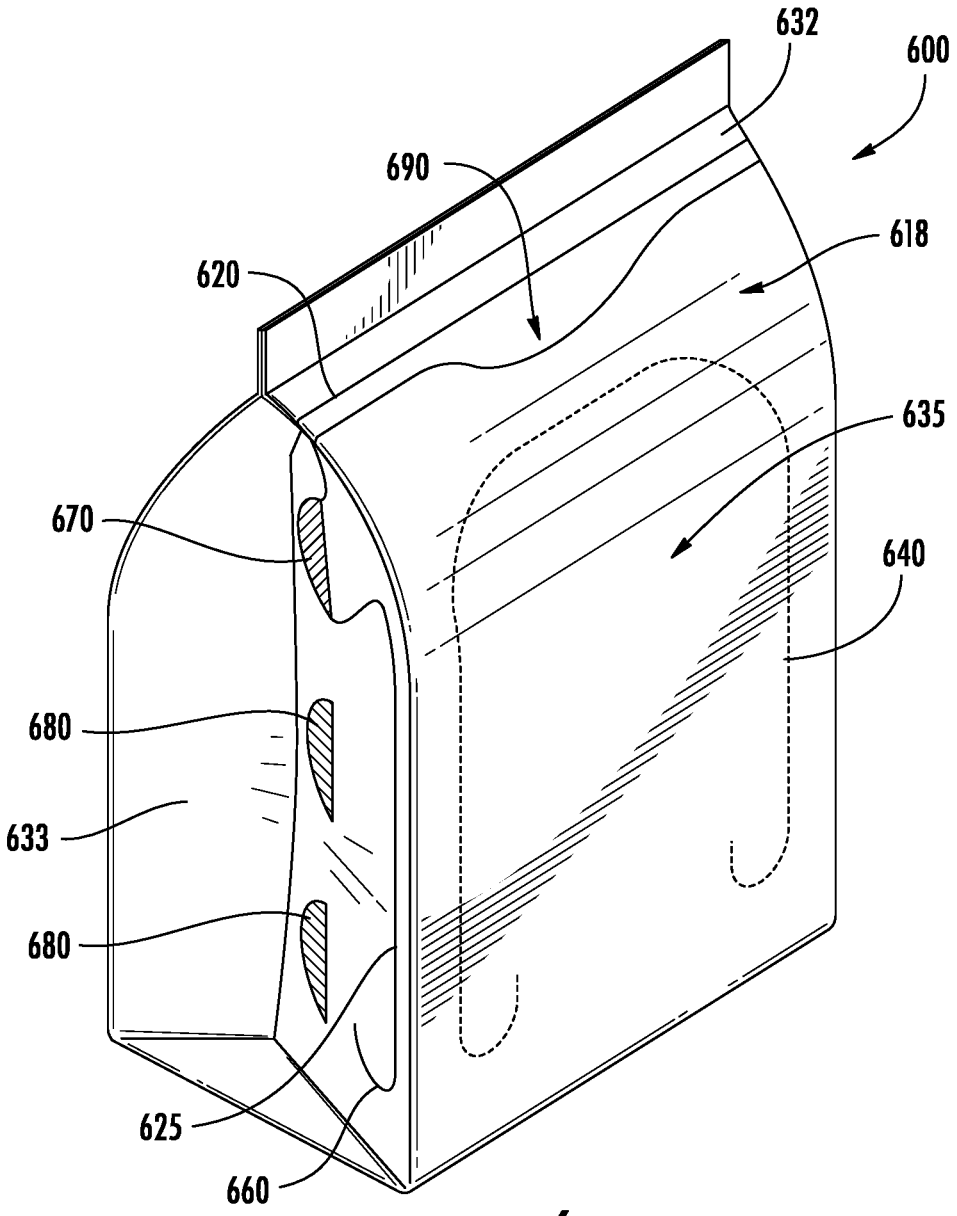
FIG. 6 illustrates an alternate embodiment of a package with a child resistant integral flap according to an embodiment of the present invention.

FIG. 6 illustrates another alternate embodiment of the invention. In this embodiment, the package 600 comprises a stand-up pouch. The access point 635 is disposed in the front wall 632, defined by cut line 640. The resealable flap 618 is defined by cut line 625, ending at the free ends 660. The opening/reclose features operate in a manner similar to that described above. Again, the label shown in FIG. 6 could be applied as a discrete label defined by cut lines 620 or as integral with the packaging structure, in which case cut lines 620 would not be present. As shown, the tab 670 is disposed above, but vertically aligned with the decoy tabs 680, disposed on the side panel 633.

Figure 9:
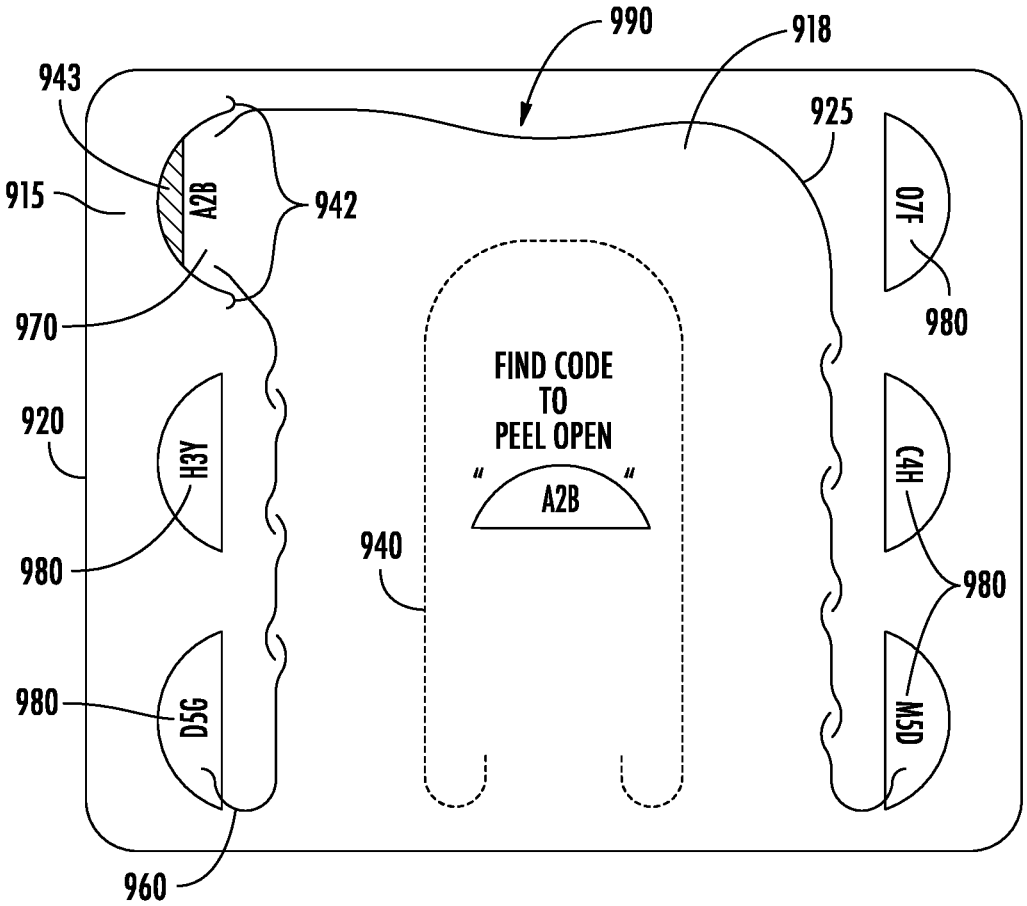
FIG. 9 is an alternate embodiment of a child resistant label according to an embodiment of the present invention.

FIG. 9 shows yet another embodiment of the invention. In this embodiment, the tab 970 is not continuous with the flap portion 918 which is defined by cut line 925. Instead, there is an interruption 942 between each end of tab 970 and cut line 925. The interruption 942 provides further evidence of tampering with the package. That is, if the interruptions 942 are broken, the package has been opened. In this embodiment, the interruptions 942 are thin film segments that are designed to remain attached until the package is opened. Upon opening of the package, the interruptions 942 stretch until they break, connecting the cut line 942 defining tab 970 with cut line 925 defining the flap portion 918. In this embodiment, an interruption 942 may be present on one or both ends of the tab 970. In FIG. 9, an outer edge 943 of the tab 970 is deadened or is adhesive-free.

Figure 10:
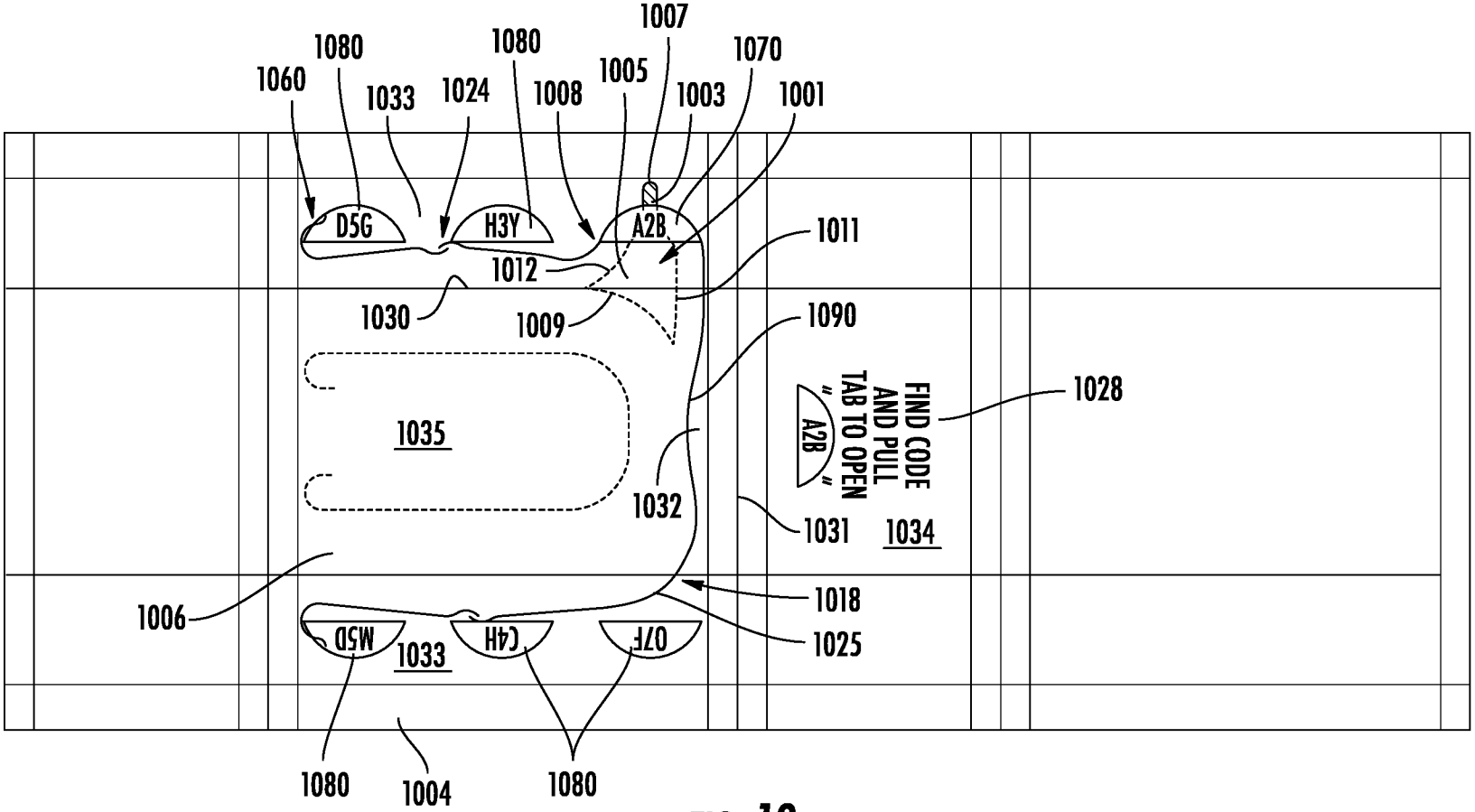
FIG. 10 illustrates a packaging structure with an integrated peelable flap according to an alternate embodiment of the present invention.
Figure 11:
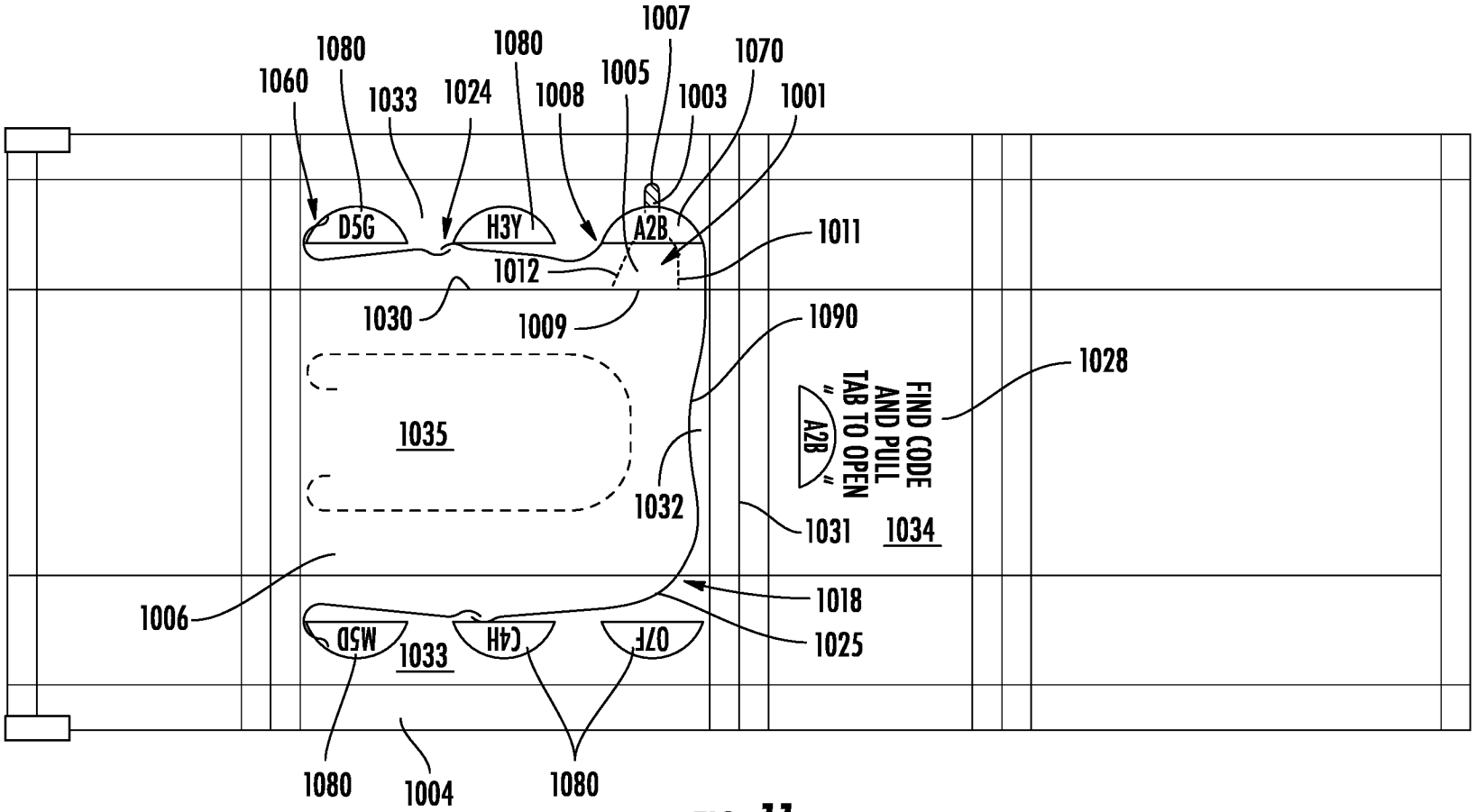
FIG. 11 illustrates a packaging structure with an integrated peelable flap according to an alternate embodiment of the present invention.

In various embodiments shown in FIGS. 10-12, a packaging structure is shown. In these embodiments, the packaging may comprise an integral peelable flap or may comprise a label to be separately applied to a packaging structure. In an embodiment, the peelable flap portion 1018 may have one tab 1070 and multiple decoy tabs 1080. The tab 1070 and one or more decoy tabs 1080 may be disposed on a side panel 1033 of the packaging structure. The opposite side panel 1033 may comprise only decoy tabs 1080, in an embodiment. In an embodiment, the instructions 1028 for opening the package may be presented on the top panel or any other panel of the structure. In an embodiment, the instructions 1028 are on a panel which is different from any panel which contains a portion of the peelable flap portion 1018.

In an embodiment, the packaging structure comprises a deadened or adhesive-free area 1001 beneath at least a portion of the tab 1070. The adhesive-free area 1001 may comprise a variety of shapes and configurations. In an embodiment, the adhesive-free area 1001 extends from within the interior of the tab 1070 to beyond the cut line which defines the edge of the tab 1070. In an embodiment, the entire area 1001 may comprise a pressure sensitive adhesive ("PSA") and there may not be an adhesive-free area.

In an embodiment, the packaging structure contains PSA area 1006. Any PSA known in the art may be utilized in this embodiment. In an embodiment, the PSA area 1006 is disposed on at least the front panel 1032 and at least partially on one of the side panels 1033 of the structure. In this embodiment, one of the film layers may be flood coated with PSA in the PSA area 1006 and subsequently deadened in the adhesive-free area 1001. In another embodiment, the PSA may be pattern-applied to avoid the adhesive-free area 1001. In another embodiment, a wax, oil, or other component may be disposed in the adhesive-free area 1001 prior to application of the adhesive to avoid adherence of the adhesive in that area. In an embodiment, the packaging structure contains a permanent adhesive area 1004. Any permanent adhesive known in the art may be utilized in this embodiment. The permanent adhesive area 1004 may be disposed on or around various fold lines, for example, on or around fold line 1031, between the front panel 1032 and the top panel 1034. In an embodiment, permanent adhesive 1004 is disposed in a perimeter around the peelable flap portion 1018.

In an embodiment, the adhesive-free area 1001 extends from within the interior of the tab 1070 to substantially the end of the PSA area 1006. In an embodiment, the adhesive-free area 1001 extends from within the interior of the tab 1070 to substantially the beginning of the permanent adhesive area 1004.

In an embodiment, the adhesive-free zone 1001 extends from the side panel 1033 at least partially into the front panel 1032. In an embodiment, the adhesive-free zone 1001 is disposed only on the side panel 1033 and ends at or substantially near the fold line 1030 between the side panel 1033 and the front panel 1032. In an embodiment, the adhesive-free zone 1001 directs the tearing of the tab 1070 along the designated cut lines 1025.

In an embodiment, the adhesive-free zone 1001 is generally bell shaped or plunger shaped, with the handle 1003 of the bell or plunger extending at least partially beyond the cut line which defines the edge of the tab 1070. In this embodiment, the bell or plunger portion 1005 of the adhesive-free zone 1001 is disposed on the side panel 1033 and extends at least partially into the front panel 1032. In an embodiment, the handle 1003 of the adhesive-free zone 1001 has an extended, narrower shape than the plunger portion 1005 of the adhesive-free zone 1001. In an embodiment, the handle 1003 of the adhesive-free zone 1001 has a curved distal portion 1007, opposite the plunger portion 1005 of the adhesive-free zone 1001. In an embodiment, the plunger portion 1005 of the adhesive-free zone 1001 has a bell-shaped, curved perimeter which extends toward the front panel 1032. In an embodiment, the base 1009 of the plunger portion 1005, opposite the handle 1003, comprises a straight cut line (see FIGS. 11-12). As shown in FIG. 10, however, the base 1009 of the plunger portion 1005 may have a curvature and may, in an embodiment, have a concave curvature.

As shown in FIGS. 10-11, the cut line 1025 which defines the peelable flap portion 1018 may have a different length on either side of the recessed portion 1090. Alternatively, the cut line 1025 which defines the peelable flap portion 1018 may have a different curvature or disposition on either side of the recessed portion 1090. For example, the segment of the cut line 1025 which is left of the recessed portion 1090 may be disposed closer to the fold line 1031 between the front panel 1032 and the top panel 1034 than is the segment of the cut line 1025 which is right of the recessed portion 1090, looking at the package from the front.

In an embodiment, the cut line 1025 is disposed differently based upon the location of the tab 1070 versus the locations of the decoy tab(s) 1080. Thus, the segment of the cut line 1025 which is between the tab 1070 and the recessed portion 1090 may be disposed closer to the fold line 1031 between the front panel 1032 and the top panel 1034 than is the segment of the cut line 1025 which is on the other side of the recessed portion 1090. Similarly, the segment of the cut line 1025 which is between the tab 1070 and the recessed portion 1090 may have a different radius of curvature, location, or disposition than the segment of the cut line 1025 which is on the other side of the recessed portion 1090. That is, the peelable label 1018 may be asymmetrical in one or more ways.

In an embodiment, the segment of the cut line 1025 which is disposed between the tab 1070 and its nearest free end 1060 may be angled and/or curved. In some embodiments, providing a straight or substantially straight cut line 1025 between the tab 1070 and its nearest free end 1060 causes the film to separate slightly at the location of the cut line 1025 or to be detectable by touch. The inventors have found that utilizing a curved or angled cut line 1025, between the tab 1070 and its nearest free end 1060 prevents unwanted separation or tactile detection at the location of the cut line 1025. This aids in the child safety features, as children cannot easily find the cut line 1025 using the sense of touch.

In an embodiment, the segment of the cut line 1025 which is disposed between the tab 1070 and its nearest free end 1060 may be angled and/or curved both upwardly and downwardly between the tab 1070 and the free end 1060. In this embodiment, the tab 1070 may be defined by a semi-circular, semi-ovular, or semi-elliptical perimeter, or any other curved perimeter shape (for example, a partial circle which is less than half of a circle) which may provide a grippable tab. In an embodiment, the tab 1070 may be a convex configuration. At the edge 1008 of the tab 1070 nearest the free end 1060 of the cut line 1025, the cut line 1025 may curve concavely. Traveling toward the free end 1060 of the cut line 1025, the cut line 1025 may then extend outwardly, away from the fold line 1030, in a curved or angled manner. One or more interrupted areas 1024 may be presented along the cut line 1025, between the tab 1070 and its nearest free end 1060. In an embodiment, the curvature or angled nature of the cut line 1025, as discussed herein, may reduce the number of interrupted areas 1024 that are utilized in the packaging. For example, the interrupted areas 1024 may serve not only as tamper evidence features, but may also aid in allowing the film near the cut line 1025 to lay flat. Creating variations (angles and/or curvatures) in the cut line 1025 may allow the packaging to lay flat at or near the cut line 1025 with fewer interrupted areas 1024.

In an embodiment, only one interrupted area 1024 is disposed between the tab 1070 and its nearest free end 1060. In this embodiment, the cut line 1025 may curve concavely near the edge 1008 of the tab 1070 nearest the free end 1060. The cut line 1025 may then extend outwardly, away from the fold line 1030, in a curved or angled manner, toward the interrupted area 1024. Past the interrupted area 1024, the cut line 1025 may then extend inwardly, toward from the fold line 1030, in a curved or angled manner, until it reaches the free end 1060. In this embodiment, there is no portion of the cut line 1025, between the tab 1070 and its nearest free end 1060, which is straight and/or parallel to the fold line 1030.

FIGS. 13A-13F illustrate a variety of interrupted areas 1324 which may be utilized in combination with any of the embodiments discussed herein. The interrupted areas 1324 shown in FIG. 13 each comprise a small j-hook.

FIG. 12 illustrates a variety of adhesive-free areas 1001 which are envisioned by the present invention. In these embodiments, the adhesive-free area 1001 may be bell- or plunger-shaped, as discussed above. Alternatively, the adhesive-free area 1001 may be an elongated oval (shown in FIGS. 12A-12C), circle, or ellipse. In some embodiment, the two sides (1011, 1022) of the plunger portion 1005 are not symmetrical.

In some embodiments, the width of the handle portion 1003 of the adhesive-free area 1001 (or the entirely of the adhesive-free area 1001 as in FIGS. 12A-12C) is narrower than the width of the tab 1070. In an embodiment, the width of the tab 1070 may be substantially greater than the width of the handle portion 1003 of the adhesive-free area 1001. For example, the width of the handle portion 1003 of the adhesive-free area 1001 may be $1/8^{th}$, $1/6^{th}$, $1/4^{th}$, $1/3^{rd}$, or $1/2$ the width of the tab 1070. In an embodiment, the width of the handle portion 1003 of the adhesive-free area 1001 may be between $1/16$ inches and $3/16$ inches. In an embodiment, the adhesive-free area 1001 is centered within the tab 1070. In an embodiment, the width of the handle portion 1003 of the adhesive-free area 1001 is designed to be small enough to not be obvious to children, but large enough to fit a fingernail beneath to pull the tab away from the packaging structure, and intuitive enough for senior citizens to be able to open the package. In an embodiment, handle portion 1003 of the adhesive-free area 1001 is designed as the initial access point into the package.

Figure 12A:
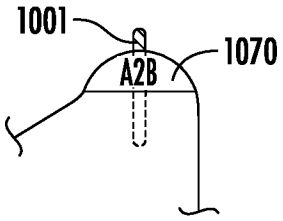
FIG. 12A-12L illustrates exemplary pull tabs in various embodiments of the present invention.
Figure 12D:
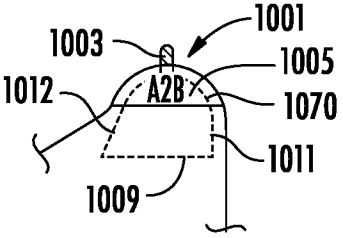
Figure 12G:
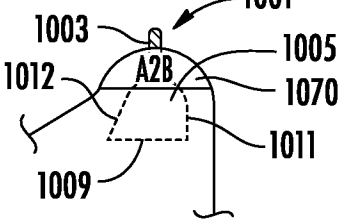
Figure 12J:
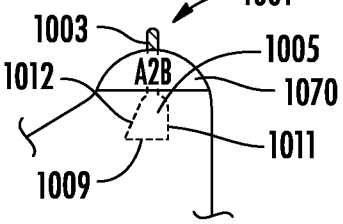
Figure 12B:
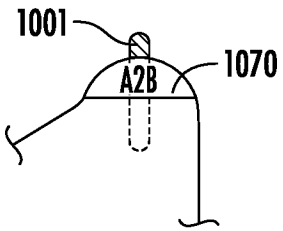
Figure 12E:
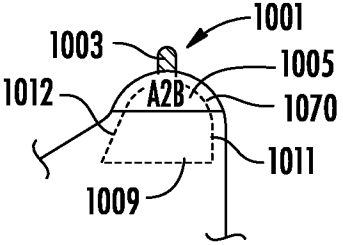
Figure 12H:
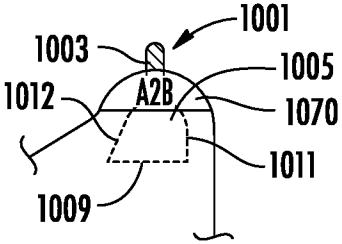
Figure 12K:
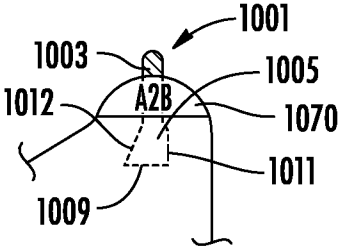
Figure 12C:
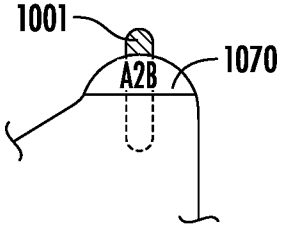
Figure 12F:
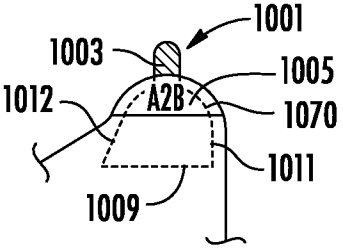
Figure 12I:
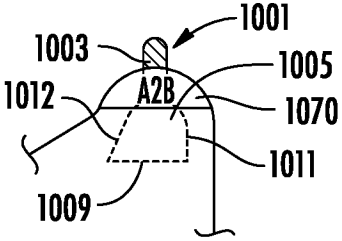
Figure 12L:
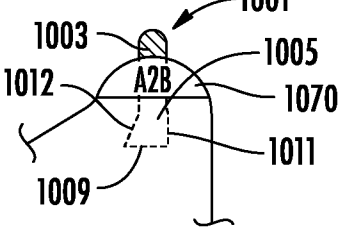
Figure 13A:
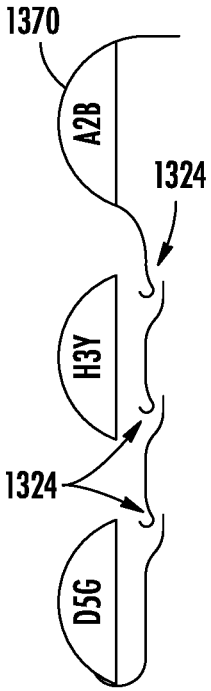
FIG. 13A-13F illustrates exemplary interrupted areas in various embodiments of the present invention.
Figure 13B:
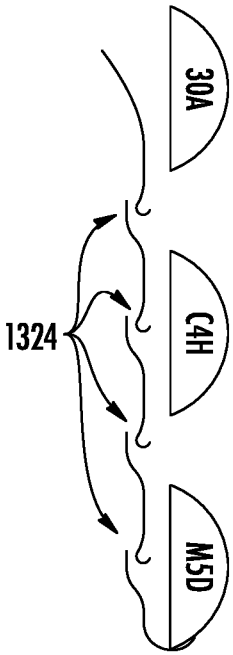
Figure 13C:
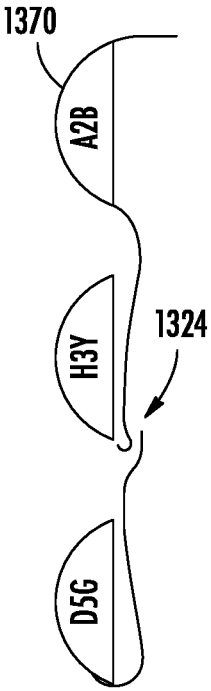
Figure 13D:
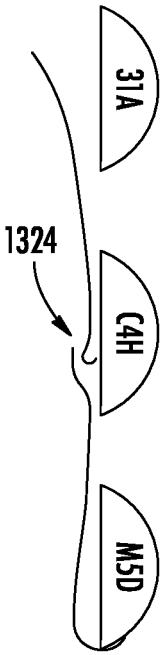
Figure 13E:
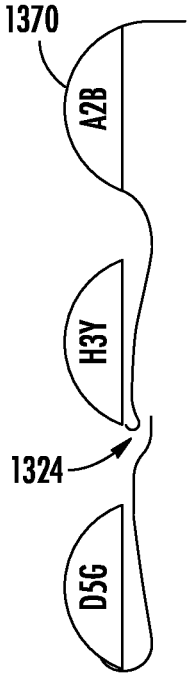
Figure 13F:
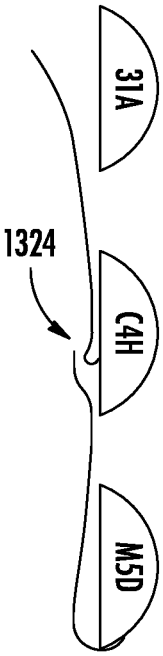

FIGS. 12D-12L illustrate variations on the bell- or plunger-shaped adhesive-free area 1001. The plunger portion 1005 of the adhesive-free zone 1001 may have a variety of widths and sizes. The plunger portion 1005 of the adhesive-free zone 1001 may extend nearly to the edge of the tab 1070, such as is shown in FIGS. 12D through 12F) or may be more centrally-located, such as is shown in FIGS. 12J through 12L.

In an embodiment, the curvature or angle on one side of the plunger portion 1005 may be different from the curvature or angle on the other side of the plunger portion 1005. The section of the plunger portion 1005 which is disposed nearest the handle 1007 may be generally convex. The section of the plunger portion 1005 which is disposed nearest the handle 1007 may be similar in configuration to the tab 1007. The plunger portion 1005 may extend from its convex curve near the handle 1007 toward the base 1009 of the adhesive-free zone 1001. The perimeter section of the plunger portion 1005 which is disposed closest to the fold line 1031 between the front panel 1032 and the top panel 1034, the first side 1011, may taper from the convex curve to become a straight or nearly straight line which ends at the base 1009. On the other hand, the perimeter section of the plunger portion 1005 which is disposed furthest from the fold line 1031 between the front panel 1032 and the top panel 1034, the second side 1012, may have a different angle, curvature, shape, or configuration from that of the first side 1011 of the plunger portion 1005. Using the fold line 1031 between the front panel 1032 and the top panel 1034 as a zero angle, the first side 1011 of the plunger portion 1005 may also have a zero angle, but the second side 1012 of the plunger portion 1005 may have an angle which is greater than zero. In an embodiment, the first side 1011 of the plunger portion 1005 has a non-zero angle and the second side 1012 of the plunger portion 1005 has a non-zero angle which is greater than that of the first side 1011. In an embodiment, the second side 1012 of the plunger portion 1005 may have a concave portion, as shown in FIG. 10.

In an embodiment, the varied angles and curvatures of the first side 1011 and the second side 1012 of the plunger portion 1005 aid in directing the peelable flap portion 1018 as it is opened. That is, the greater angle on the second side 1012 of the plunger portion directs the tab 1070 and peelable flap 1018 in general to open toward the access point 1035.

It should be noted that the term "cut line" as used herein may refer to a complete cutting through the thickness of one or more layers, a partial cutting through of the thickness of such layer(s), allowing the layer(s) to be severed along the score line, or a multiple perforations through the thickness of one or more layers. In an embodiment, the cut line extends into an adhesive layer between two film layers.

In certain embodiments, the packaging described herein is formed by enveloping the contents in a packaging structure which has an integral peelable flap portion as described herein. Alternatively, however, it is within the scope of the invention to employ the label 15 as a lidding stock for forming flexible lids that can be secured (e.g., by heat-sealing or the like) to a flange of a tray or other container that contains the contents. Likewise, the label 15 may be applied to a pillow pouch, can end, or any other container or packaging structure known in the art. In this manner, the lid includes a built-in opening and reclose feature as previously described.

Figure 14:
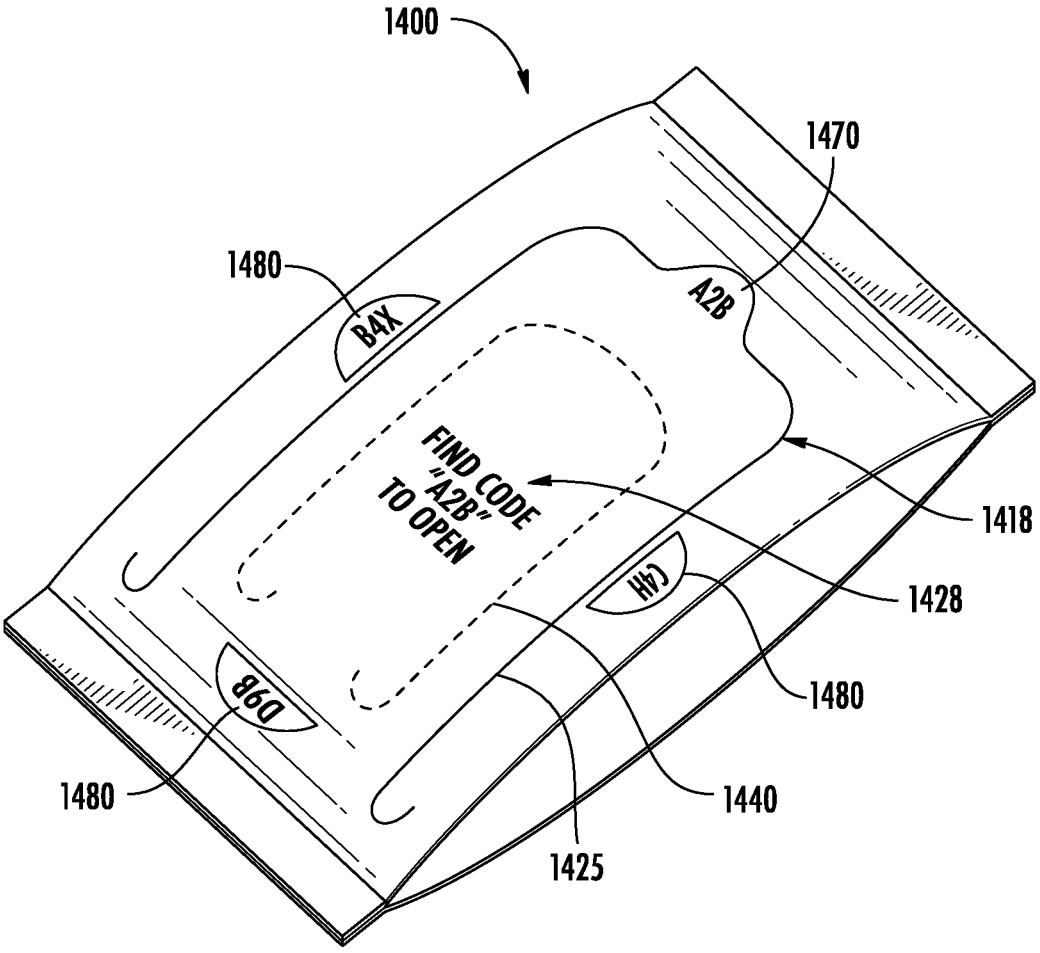
FIG. 14 illustrates an alternate embodiment of a child resistant package according to an embodiment of the present invention.

For example, FIG. 14 illustrates an exemplary pillow pouch 1400 which has a cut line 1425 defining the peelable flap portion 1418. The peelable flap 1418 comprises a tab 1470 and, in this example, three decoy tabs 1480. Any number of decoy tabs may be utilized. The figure also illustrates the code 1428 and the undercut inner cut line 1440. Because the pillow pouch does not have sidewalls and top and bottom walls, the entire peelable flap portion 1418, tab 1470, and cut line 1425 may be disposed on the front panel of the package. The pillow pouch 1400 may have an integral peelable flap portion 1418 or a discrete label may be applied to the pillow pouch to provide the child resistant packaging.

While the invention is described herein as having decoy tabs, it should be understood that the decoy tabs may be omitted. For example, in some embodiments, the code may indicate that the pull tab is located in a particular location of the graphical display—such as on the shoe of the character shown on the packaging (i.e. "Pull Tab is Ralphie's Left Shoe"), in a particular color range (i.e. "Pull Tab is the Blue Oval"), or within wording (i.e. "Pull Tab is the "0" in the Word Olive"). Thus, the invention covers embodiments wherein the pull tab is disguised or camouflaged by the packaging graphics and would not be readily identifiable but for the code or instructions provided on the packaging. In still another embodiment, a misalignment of graphics provides an indication of the pull tab. For example, if all of the graphics in the packaging are aligned but for one particular area, that may be an indicator that the functioning pull tab is located in that position. In an embodiment, the code/instructions are always located in the same position. In an embodiment, the functioning pull tab is always located in the same position, allowing users to learn and become more comfortable with opening the packaging after repeated use.

While the packaging and labels discussed herein are referred to as having two layers, an inner layer and an outer layer, any number of film layers may be utilized. For example, in an embodiment, the inner layer may comprise a plurality of layers and/or the outer layer may comprise a plurality of layers. For example, one or both of the inner and outer layers may comprise two layers: oriented polypropylene (OPP) and polyethylene (PE). The various layers may be adhered or co-extruded. In an embodiment, the inventive packaging comprises three layers or plies.

Method of Manufacture

Discrete Label

In an embodiment, a discrete label of the invention (shown in FIG. 4B, for example) is manufactured according to the method described herein. In this embodiment a roll of film may be advanced from a supply roll by suitable web driving and handling equipment to an optional print station comprising a printing apparatus, such as a rotogravure printer or the like, for printing tabs, decoy tabs, graphics and/or indicia on the film by applying inks to a surface of the film. In an embodiment, the film may be printed on its inner or outer surface. The printing may comprise the various indicia 426 and directions 428 of the invention. The printing may also comprise colors, shapes, lines, and/or patterns which indicate the tabs 470 and the decoy tabs 480.

Prior to printing the film in the print station, the surface of the film can be treated by a corona discharge or flame treatment apparatus to render the surface more receptive to the inks and/or to render the surface more readily bondable to the PSA that is subsequently applied to the surface as described below. Alternatively, the film can have already been so treated prior to being wound into the supply roll, such that the treatment apparatus is unnecessary.

The film is then advanced to an adhesive application station at which an adhesive is applied to the film. In an embodiment, the adhesive is a PSA and is applied in a predetermined pattern, optionally avoiding (leaving adhesive-free) the underside of the resealable flap portion 418 and/or the tabs 470. In alternative embodiments, the film may be flood-coated with PSA onto the entire surface of the film and the PSA may later be deadened or deactivated in regions (noted above) which are designed to be adhesive-free. In some embodiments, a combination of permanent and pressure sensitive adhesive may be pattern applied or flood coated and deadened/deactivated.

The adhesive application station can comprise any suitable device capable of accurately applying the adhesive to the film in the desired pattern or as flood coated. For example, the adhesive application station can comprise a gravure roll that picks up the adhesive from a reservoir on the outer surface of the roll such that the adhesive fills one or more recessed areas in the surface. A doctor blade can scrape off excess adhesive so that it remains essentially only in the recessed area(s). The film is then contacted by the gravure roll to apply the adhesive. A backing roll may provide support on the opposite side of the film. After application of the adhesive, the film may be advanced to a dryer such as an oven or the like, to dry or partially dry the adhesive.

After application of the adhesive, the film may be advanced to a station for application of a backing or release liner. The film may be passed through a nip along with a backing or release liner that is advanced from its own supply roll, and the film and release liner may be affixed to each other. The release liner may be coextensive with the film—i.e., the width of the release liner is substantially equal to the width of the film and the longitudinal edges of the release liner substantially coincide with the longitudinal edges of the film. The resulting lined film may then be advanced to a reel-up where it is wound into a roll for subsequent processing. Alternatively, it is possible for the reel-up operation to be omitted, such that the laminate is directly advanced.

In an embodiment, the lined film is then advanced to a scoring station at which score line 425 (FIG. 4B) is formed. The scoring station can comprise a laser or a mechanical cutting die. Optionally, one or more decoy tabs may be scored as discontinuous with the score line 425.

After the scoring operation, the lined film can be sent to a reel-up and wound into a roll for subsequent processing. The lined film can alternatively be cut into a plurality of labels. The labels may later be applied to a package by removing the liner/backing and adhering the labels to a packaging structure or package in an off-line process.

Integral Laminated Packaging Structure

In an embodiment, an integral laminated packaging structure and label of the invention (shown in FIG. 8) is manufactured according to the method described herein. In this embodiment a first roll of film may be advanced from a first supply roll to an optional print station comprising a printing apparatus for printing tabs, decoy tabs, graphics and/or indicia on the film by applying inks to a surface of the first film. In an embodiment, the film may be printed on its inner or outer surface, as described above.

Prior to printing the first film in the print station, the surface of the first film can be treated by corona discharge or flame treatment, as noted above. The first film may then be advanced to an adhesive application station at which an adhesive is applied to the first film, as described above. After application of the adhesive, the film may be advanced to a dryer such as an oven or the like, to dry or partially dry the adhesive.

Optionally, the first film may then be advanced to a second adhesive application station at which a second adhesive, possibly a permanent laminating adhesive, may be applied to the film in a pattern. If the film includes an adhesive-free region as previously noted, the pattern of the second adhesive also does not cover the adhesive-free region. A suitable adhesive application device can be a gravure roll of the type previously described. After the optional application of the second adhesive, the film may be advanced to a second dryer such as an oven or the like.

After application of the adhesive, the first film may then be advanced to a laminating station, comprising a pair of rolls forming a nip therebetween. The first film is passed through the nip along with a second structure that is advanced from its own supply roll. The second structure may comprise a flexible film or any other packaging structure as described herein. The first film and the second structure are then laminated to each other. The second structure may be coextensive with the first film, as noted above. The resulting laminate may then be advanced to a reel-up where it is wound into a roll for subsequent processing. Alternatively, it is possible for the reel-up operation to be omitted, such that the laminate is directly advanced.

In an embodiment, the lined film is then advanced to a scoring station at which a first score line 125 is formed. The scoring station can comprise a laser or a mechanical cutting die. The first score line 125 may extend substantially through the thickness of the first film, but preferably does not extend to any substantial extent into the second structure. Optionally, one or more decoy tabs may be at least partially scored. In this embodiment, the decoy tabs would not be continuous with the score line 125.

Optionally, the laminate is then advanced to a second scoring station at which a second, or inner, score line 140 is undercut and formed through the thickness of the second structure. The second score line 140 extends substantially through the thickness of the second structure, but preferably does not extend to any substantial extent into the first film. The second score line 140 is spaced inwardly of the first score line 125 so as to define an access point 135 of smaller area than the resealable flap portion 118. The portion of the second structure which covers access point 135 may be adhered to the resealable flap portion 118 (by an adhesive), such that both portions are lifted together when opening the package. Alternatively, the portion of the second structure which covers access point 135 may be removed from the laminate and discarded after cutting second score line 140, such that when resealable flap portion 118 is lifted from the package, access point 135 is presented. After the scoring operations, the laminate can be processed as set forth above.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A child resistant laminate package comprising a first panel and at least one second panel joined to the first panel, wherein the at least one second panel is disposed in a plane which is different from the plane of the first panel, and wherein the first and at least one second panels comprise:

an inner film layer;

an outer film layer;

an adhesive layer disposed between the inner film layer and the outer film layer;

wherein the outer film layer is scored to form at least one peelable flap portion comprising at least one tab which is continuous with the at least one peelable flap portion, wherein the at least one tab is disposed at least partially on one of the at least one second panel;

wherein the inner film layer is scored to form at least one access point into the package, wherein the at least one access point is disposed at least partially within the location of the at least one peelable flap portion;

wherein the access point is disposed at least partially in the first panel; and wherein at least one decoy tab is disposed on the at least one second panel such that the at least one decoy tab is not scoredly continuous with the at least one peelable flap portion.

2. The package of claim 1, wherein the adhesive layer comprises pressure sensitive adhesive.

3. The package of claim 2, wherein the at least one peelable flap portion is resealable to the inner film layer via the pressure sensitive adhesive layer.

4. The package of claim 2, wherein the pressure sensitive adhesive layer is disposed on a lower surface of the outer film.

5. The package of claim 1, wherein the at least one decoy tab is visually displayed but is not scored.

6. The package of claim 1, wherein the perimeter of the at least one decoy tab is at least partially scored.

7. The package of claim 1, wherein the at least one decoy tab is disposed adjacent the at least one tab.

8. The package of claim 1, wherein the at least one tab and the at least one decoy tab contain indicia and wherein the indicia associated with the at least one tab is different from the indicia associated with the at least one decoy tab.

9. The package of claim 1, wherein the at least one tab and the at least one decoy tab comprise substantially the same shape and size.

10. The package of claim 1, wherein the at least one tab and the at least one decoy tab are positioned in substantially the same configuration.

11. The package of claim 1 wherein the at least one decoy tab comprises a plurality of decoy tabs.

12. The package of claim 11 comprising at least two second panels, wherein at least one decoy tab is positioned on a second panel and wherein at least one decoy tab is positioned on a different second panel.

13. The package of claim 1, wherein the wherein the score in the inner film layer is formed inwardly of the score in the outer film layer.

14. The package of claim 1, wherein at least part of the at least one tab is not adhered to the inner film layer.

15. The package of claim 1 comprising at least two second panels, wherein the perimeter of the at least one peelable flap portion comprises a connecting portion and two leg portions and wherein each of the leg portions is disposed at least partially on a different second panel of the package.

16. The package of claim 15 wherein the connecting portion of the at least one peelable flap portion perimeter comprises a recessed portion which extends toward a hinge line disposed between the free ends of the leg portions.

17. The package of claim 1, wherein the perimeter of the at least one peelable flap portion comprises a connecting portion and two leg portions and wherein the leg portions comprise at least one interrupted area.

18. The package of claim 1, comprising at least two second panels, wherein the at least two second panels are disposed on opposite sides of the first panel.

19. The package of claim 1, wherein the at least one peelable flap portion comprises a plurality of tabs which are continuous with the at least one peelable flap portion.

* * * * *